US009605862B2

(12) United States Patent
Eguchi et al.

(10) Patent No.: US 9,605,862 B2
(45) Date of Patent: Mar. 28, 2017

(54) AGGREGATED CHANNEL SWITCHING UNIT AND METHOD OF MANUFACTURING SAME

(71) Applicant: DAIKIN INDUSTRIES, LTD., Osaka-shi, Osaka (JP)

(72) Inventors: Akihiro Eguchi, Sakai (JP); Shigeki Kamitani, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/103,241

(22) PCT Filed: Dec. 3, 2014

(86) PCT No.: PCT/JP2014/082004

§ 371 (c)(1),
(2) Date: Jun. 9, 2016

(87) PCT Pub. No.: WO2015/087756

PCT Pub. Date: Jun. 18, 2015

(65) Prior Publication Data

US 2016/0356516 A1 Dec. 8, 2016

(30) Foreign Application Priority Data

Dec. 11, 2013 (JP) ..... 2013-256479

(51) Int. Cl.
*F25B 39/02* (2006.01)
*F24F 11/00* (2006.01)
(Continued)

(52) U.S. Cl.
CPC ..... *F24F 11/008* (2013.01); *F24F 1/32* (2013.01); *F24F 3/065* (2013.01); *F24F 5/001* (2013.01);
(Continued)

(58) Field of Classification Search
CPC ..... F25B 39/028; F25B 39/02; F25B 5/02; F25B 41/04
(Continued)

(56) References Cited

U.S. PATENT DOCUMENTS 2,082,403 A * 6/1937 Larkin ..... F25B 39/028 138/37
2,722,809 A * 11/1955 Morrison ..... F25D 17/042 62/279
(Continued)

FOREIGN PATENT DOCUMENTS

JP 2001-241696 A 9/2001
JP 2008-39276 A 2/2008
JP 2010-286129 A 12/2010

OTHER PUBLICATIONS

International Search Report of corresponding PCT Application No. PCT/JP2014/082004 dated Mar. 3, 2015.
(Continued)

*Primary Examiner* — Melvin Jones
(74) *Attorney, Agent, or Firm* — Global IP Counselors

(57) ABSTRACT

An aggregated channel switching unit is disposed between a heat source unit and a plurality of utilization units to switch flow of refrigerant in the refrigerant circuit. The aggregated channel switching unit including a plurality of first refrigerant pipes having switch valves, a plurality of second refrigerant pipes, and a casing accommodating the first and second pipes. The first and second pipes are aggregated as an assembly. The first pipes are connected to a high-low pressure gas communicating pipe and a suction gas communicating pipe extending from the heat source unit. The second refrigerant pipes are connected to a liquid communicating pipe extending from the heat source unit and a liquid pipe extending to the utilization units. Adjacent pairs of the first and second pipes extend approximately in parallel
(Continued)

to each other at predetermined intervals in the assembly. The first and second pipes are alternately disposed in the assembly.

18 Claims, 23 Drawing Sheets

(51) Int. Cl.

| | |
|---|---|
| ***F24F 1/32*** | (2011.01) |
| ***F24F 5/00*** | (2006.01) |
| ***F25B 43/00*** | (2006.01) |
| ***F25B 40/02*** | (2006.01) |
| ***F25B 13/00*** | (2006.01) |
| ***F24F 3/06*** | (2006.01) |

(52) U.S. Cl.
CPC ..... *F25B 13/00* (2013.01); *F25B 40/02* (2013.01); *F25B 43/003* (2013.01); *F24F 2011/0082* (2013.01); *F25B 2313/027* (2013.01); *F25B 2313/0233* (2013.01); *F25B 2400/05* (2013.01)

(58) Field of Classification Search
USPC ..... 62/504, 515, 527, 199, 189; 236/49.4
See application file for complete search history.

(56) References Cited

U.S. PATENT DOCUMENTS

| | | | | |
|---|---|---|---|---|
| 4,631,926 | A * | 12/1986 | Goldshtein | F25B 39/028 62/115 |
| 2006/0179873 | A1* | 8/2006 | Yoshimi | F25B 43/003 62/474 |

OTHER PUBLICATIONS

International Preliminary Report of corresponding PCT Application No. PCT/JP2014/082004 dated Jun. 23, 2016.

* cited by examiner

AGGREGATED CHANNEL SWITCHING UNIT AND METHOD OF MANUFACTURING SAME

CROSS-REFERENCE TO RELATED APPLICATIONS

This U.S. National stage application claims priority under 35 U.S.C. §119(a) to Japanese Patent Application No. 2013-256479, filed in Japan on Dec. 11, 2013, the entire contents of which are hereby incorporated herein by reference.

TECHNICAL FIELD

The present invention relates to an aggregated channel switching unit configured to switch flow of refrigerant and a method of manufacturing the same.

BACKGROUND ART

A refrigeration apparatus and the like have been provided so far with a refrigerant channel switching unit disposed between a heat source unit and a plurality of utilization units in order to switch flow of refrigerant. For example, in an air conditioning system disclosed in (Japan Laid-open Patent Application Publication No 2008-39276, a plurality of refrigerant channel switching units are disposed between a heat source unit and a plurality of utilization units such that each utilization unit is capable of independently selecting either a cooling operation or a heating operation.

SUMMARY

Technical Problem

The refrigerant channel switching units are generally installed in a small and narrow space such as a space above the ceiling. Hence, the refrigerant channel switching units are required to be compactly constructed. On the other hand, when a plurality of refrigerant channel switching units are provided as described in Japan Laid-open Patent Application Publication No. 2008-39276, as shown in FIG. 1, it is desired to form an aggregated channel switching unit by aggregating a plurality of the refrigerant channel switching units for convenience of construction. In FIG. 1, an aggregated channel switching unit 1 is formed by aggregating four refrigerant channel switching units 2.

However, it is difficult for the conventional aggregated channel switching unit to implement compactness, because of increasing in size with increase in number of sets of refrigerant channel switching units to be aggregated.

In light of the above, it is an object of the present invention to provide an aggregated channel switching unit that is good in compactness.

Solution to Problem

An aggregated channel switching unit according to a first aspect of the present invention is disposed between a heat source unit and a plurality of utilization units, and is configured to switch flow of refrigerant in a refrigerant circuit formed by the heat source unit and the plurality of utilization units. The aggregated channel switching unit is configured and arranged to include a plurality of first refrigerant pipes and a plurality of second refrigerant pipes. The first refrigerant pipe is configured and arranged to be provided with a switch valve. The first refrigerant pipe is configured and arranged to be connected to a high-low pressure gas communicating pipe and a suction gas communicating pipe, both of which configured and arranged to extend from the heat source unit. Every adjacent two of the plurality of first refrigerant pipes is configured and arranged to extend approximately in parallel to each other at a predetermined interval. The second refrigerant pipe is connected at one end to a liquid communicating pipe configured and arranged to extend from the heat source unit, and configured and arranged to be connected at the other end to a liquid pipe configured and arranged to extend to the utilization unit. Every adjacent two of the plurality of second refrigerant pipes is configured and arranged to extend approximately in parallel to each other at a predetermined interval. The first refrigerant pipe and the second refrigerant pipe are alternately disposed.

The aggregated channel switching unit according o the first aspect of the present invention includes: the first refrigerant pipes connected to the high-low pressure gas communicating pipe and the suction gas communicating pipe; and the second refrigerant pipes, each of which is connected at one end to the liquid communicating pipe and is also connected at the other end to the liquid pipe. In the aggregated channel switching unit, every adjacent two of the first refrigerant pipes extend approximately in parallel to each other at a predetermined interval; every adjacent two of the second refrigerant pipes extend approximately in parallel to each other at a predetermined interval; and the first refrigerant pipes and the second refrigerant pipes are alternately disposed. With the construction, the aggregated channel switching unit is enhanced in compactness.

In other words, the first refrigerant pipes and the second refrigerant pipes are alternately disposed, while every adjacent two of the first refrigerant pipes extend approximately in parallel to each other at a predetermined interval and every adjacent two of the second refrigerant pipes extend approximately in parallel to each other at a predetermined interval. Thus, the first refrigerant pipes and the second refrigerant pipes are aligned in an organized manner at predetermined clearances. As a result, empty space is reduced within the unit, and the first refrigerant pipes and the second refrigerant pipes can be compactly aggregated. Therefore, the aggregated channel switching unit can be compactly constructed, and is enhanced in compactness.

It should be noted that "extending approximately in parallel to . . . " encompasses not only a condition that a given constituent element extends completely in parallel to another constituent element but also a condition that a given constituent element extends while somewhat tilting with respect to a line arranged in parallel to another constituent element. Specifically, a given refrigerant pipe is interpreted as "extending approximately in parallel to" its adjacent refrigerant pipe when tilting with respect to a straight line extending in parallel to its adjacent refrigerant pipe at an angle of less than 10 degrees.

An aggregated channel switching unit according to a second aspect of the present invention relates to the aggregated channel switching unit according to the first aspect, and wherein the first refrigerant pipe and the second refrigerant pipes are configured and arranged to be alternately disposed in horizontal alignment.

In the aggregated channel switching unit according to the second aspect of the present invention, the first refrigerant pipes and the second refrigerant pipes are alternately disposed in horizontal alignment. With the construction, the vertical length of the aggregated channel switching unit is inhibited from increasing with increase in number of the first refrigerant pipes and that of the second refrigerant pipes. As a result, the aggregated channel switching unit is constructed with compact vertical length. Therefore, it becomes easy to install the aggregated channel switching unit even in a small and narrow space with short vertical length (e.g., space above the ceiling). Hence, the aggregated channel switching unit is enhanced in easiness of installation.

An aggregated channel switching unit according to a third aspect of the present invention relates to the aggregated channel switching unit according to the first or second aspect, and wherein the first refrigerant pipe configured and arranged to include a refrigerant pipe filter configured and arranged to remove impurities. An interval between every adjacent pair of the first refrigerant pipe and the second refrigerant pipe is smaller than a width of the refrigerant pipe filter.

In the aggregated channel switching unit according to the third aspect of the present invention, the interval between every adjacent pair of the first refrigerant pipe and the second refrigerant pipe is smaller than the width of the refrigerant pipe filter. Accordingly, the plural first refrigerant pipes and the plural second refrigerant pipes can be further compactly aggregated.

An aggregated channel switching unit according to a fourth aspect of the present invention relates to the aggregated channel switching unit according to any of the first to third aspects, and wherein the switch valve includes a first switch valve and a second switch valve. The first switch valve and the second switch valve are configured and arranged to be disposed on a straight line on which the first refrigerant pipe extends in a plan view.

In the aggregated channel switching unit according to the fourth aspect of the present invention, the first and second switch valves provided in each first refrigerant pipe are disposed on the straight line on which the first refrigerant pipe extends in a plan view. With the construction, in providing each first refrigerant pipe with a plurality of switch valves, the interval between every adjacent two of the first refrigerant pipes can be herein more reduced than when the switch valves are displaced from the straight line on which the first refrigerant pipe extends in a plan view. As a result, the plural first refrigerant pipes and the plural second refrigerant pipes can be more compactly aggregated.

It should be noted that when each of the first and second switch valves includes a part overlapping with each first refrigerant pipe in a plan view, it can be interpreted that the first and second switch valves are "disposed on a straight line on which the first refrigerant pipe extends in a plan view".

An aggregated channel switching unit according to a fifth aspect of the present invention relates to the aggregated channel switching unit according to any of the first to fourth aspects, and wherein the second refrigerant pipe is configured and arranged to provided with a supercooling heat exchange portion between the one end and the other end. The supercooling heat exchange portion is configured and arranged to cool the refrigerant passing inside the second refrigerant pipe. The supercooling heat exchange portion is configured and arranged to have a structure that heat exchange is performed between the refrigerant passing inside the second refrigerant pipe and the refrigerant passing inside another refrigerant pipe. The aforementioned another refrigerant pipe is provided with a third switch valve configured and arranged to regulate flow rate of the refrigerant passing inside the aforementioned another refrigerant pipe. The supercooling heat exchange portion is configured and arranged to extend approximately in parallel to the first refrigerant pipe.

In the aggregated channel switching unit according to the fifth aspect of the present invention, the supercooling heat exchange portion, disposed between one end and the other end of each second refrigerant pipe, has the construction that heat exchange is performed between the refrigerant passing inside the second refrigerant pipe and the refrigerant passing inside another refrigerant pipe provided with the third switch valve. Additionally, the supercooling heat exchange portion extends approximately in parallel to the first refrigerant pipe. With the construction, the aggregated channel switching unit is enhanced in compactness, and degradation in performance of the utilization units is inhibited.

In other words, with the construction that the second refrigerant pipe is provided with the supercooling heat exchange portion, in a situation that one utilization unit performs a heating operation whereas another utilization unit performs a cooling operation, it becomes possible to supercool the refrigerant condensed/radiated in the aforementioned one utilization unit, and degradation in cooling performance of the aforementioned another utilization unit is inhibited. Additionally, with the construction that the supercooling heat exchange portion extends approximately in parallel to the first refrigerant pipe, the plural first refrigerant pipes and the plural second refrigerant pipes can be compactly aggregated even when the second refrigerant pipe is provided with the aforementioned supercooling heat exchange portion. Consequently, the aggregated channel switching unit is enhanced in compactness, and degradation in performance of the utilization units is inhibited.

An aggregated channel switching unit according to a sixth aspect of the present invention relates to the aggregated channel switching unit according to any of the first to fifth aspects, and further includes a first header; a second header and a third header. The first, second and third headers configured and arranged to extend approximately in parallel to each other. The first refrigerant pipe is configured and arranged to be connected approximately perpendicularly to the first header and the second header. The first refrigerant pipe is configured and arranged to be connected to the high-low pressure gas communicating pipe through the first header The first refrigerant pipe is configured and arranged to be connected to the suction gas communicating pipe through the second header. The second refrigerant pipe is configured and arranged to be connected approximately perpendicularly to the third header. The second refrigerant pipe is configured and arranged to be connected to the liquid communicating pipe through the third header.

In the aggregated channel switching unit according to the sixth aspect of the present invention, the first refrigerant pipes are connected to the high-low pressure gas communicating pipe through the first header, and are also connected to the suction gas communicating pipe through the second header, whereas the second refrigerant pipes are connected to the liquid communicating pipe through the third header. Additionally, the first refrigerant pipes are connected approximately perpendicularly to the first header and the second header, whereas the second refrigerant pipes are connected approximately perpendicularly to the third header.

Thus, with the construction that the first refrigerant pipes or the second refrigerant pipes are connected to the high-low pressure gas communicating pipe, the suction gas communicating pipe or the liquid communicating pipe through the headers, each refrigerant pipe can be easily connected to the high-low pressure gas communicating pipe, the suction gas communicating pipe or the liquid communicating pipe, and the aggregated channel switching unit is enhanced in easiness of assembling. Additionally, with the construction that the first refrigerant pipes are connected approximately perpendicularly to the first header and the second header whereas the second refrigerant pipes are connected approximately perpendicularly to the third header, the plural first refrigerant pipes and the plural second refrigerant pipes can be compactly aggregated in organized alignment even when the first refrigerant pipes or the second refrigerant pipes are connected to the high-low pressure gas communicating pipe, the suction gas communicating pipe or the liquid communicating pipe through the headers. Therefore, the aggregated channel switching unit is enhanced in compactness and easiness of assembling.

It should be noted that "connected approximately perpendicularly to . . . " encompasses not only a condition that a given constituent element is connected completely perpendicularly to another constituent element but also a condition that a given constituent element is connected to another constituent element while slightly tilting with respect to a line perpendicular to the aforementioned another constituent element. Specifically, a given refrigerant pipe is interpreted as "connected approximately perpendicularly to" a given header when tilting with respect to a line perpendicular to the given header at an angle of less than 10 degrees.

An aggregated channel switching unit according to a seventh aspect of the present invention relates to the aggregated channel switching unit according to the sixth aspect, and further includes a fourth header, a connecting pipe and a bypass pipe. The fourth header is configured and arranged to extend approximately in parallel to the first, second and third headers. The connecting pipe is configured and arranged to connect the second header and the fourth header and configured and arranged to feed the refrigerant inside the second header to the fourth header. The connecting pipe is configured and arranged to include a first part and a second part. The first part is configured and arranged to extend in a direction intersecting with an extending direction of the fourth header. The second part is configured and arranged to extend approximately in parallel to the extending direction of the fourth header and configured and arranged to be connected to the first part. The first part is configured and arranged to extend approximately in parallel to the extending direction of the fourth header in a connected part thereof to the second part. The bypass pipe is configured and arranged to bypass the refrigerant inside the fourth header to the second refrigerant pipe. The bypass pipe is configured and arranged to be connected approximately perpendicularly to the fourth header. In the aggregated channel switching unit according to the seventh aspect, the fourth header is provided, and hence, it is possible to inhibit pipes from being connected in a complex aspect in a construct for bypassing the refrigerant inside the second header to the second refrigerant pipe. Therefore, the aggregated channel switching unit is enhanced in easiness of assembling.

Additionally, the fourth header extends approximately in parallel to the first, second and third headers. The connecting pipe, connecting the second header and the fourth header, includes the first part and the second part, and the first part extends in a direction intersecting with the extending direction of the fourth header whereas the second part extends approximately in parallel to the extending direction of the fourth header and is connected to the first part. The bypass pipe, bypassing the refrigerant inside the fourth header to the second refrigerant pipe, is connected approximately perpendicularly to the fourth header. Accordingly, even when the fourth header is provided, the plural first refrigerant pipes and the plural second refrigerant pipes can be compactly aggregated in organized alignment. Therefore, the aggregated channel switching unit is enhanced in compactness and easiness of assembling.

A method of manufacturing an aggregated channel switching unit according to an eighth aspect of the present invention is a method of manufacturing the aggregated channel switching unit according to the seventh aspect, and includes a first step, a second step and a third step. In the first step, a first assembly is fabricated. The first assembly is fabricated by connecting the first header or the second header and the plurality of first refrigerant pipes. In the second step, a second assembly is fabricated. The second assembly is fabricated by connecting the third header or the fourth header and the plurality of second refrigerant pipes. In the third step, the first assembly and the second assembly are combined.

The method of manufacturing the aggregated channel switching unit according to the eighth aspect of the present invention includes: the first step of fabricating the first assembly by connecting the first header or the second header and the plural first refrigerant pipes; the second step of fabricating the second assembly by connecting the third header or the fourth header and the plural second refrigerant pipes; and the third step of combining the first assembly and the second assembly. Accordingly, it is possible to easily and efficiently manufacture the aggregated channel switching unit that is good in compactness.

In other words, in manufacturing a conventional aggregated channel switching unit, assembling effort and the number of assembling steps have increased with increase in number of refrigerant channel switching units to be combined. Compared to this, in the method of manufacturing the aggregated channel switching unit according to the eighth aspect, assembling effort and the number of assembling steps are inhibited from increasing with increase in number of refrigerant channel switching units to be combined. Accordingly, it is possible to easily and efficiently manufacture the aggregated channel switching unit that is good in compactness.

Advantageous Effects of Invention

In the aggregated channel switching unit according to the first aspect of the present invention, the plural first refrigerant pipes and the plural second refrigerant pipes can be compactly aggregated. Thus, the aggregated channel switching unit is enhanced in compactness.

In the aggregated channel switching unit according to the second aspect of the present invention, easiness of installation is enhanced.

In the aggregated channel switching unit according to the third aspect of the present invention, the plural first refrigerant pipes and the plural second refrigerant pipes can be more compactly aggregated.

In the aggregated channel switching unit according to the fourth aspect of the present invention, the plural first refrigerant pipes and the plural second refrigerant pipes can be compactly aggregated even when each first refrigerant pipe is provided with a plurality of valves.

In the aggregated channel switching unit according to the fifth aspect of the present invention, the aggregated channel switching unit is enhanced in compactness, and simultaneously, degradation in performance of the utilization units is inhibited.

In the aggregated channel switching unit according to each of the sixth and seventh aspects of the present invention, the aggregated channel switching unit is enhanced in compactness and easiness of assembling.

In the method of manufacturing the aggregated channel switching unit according to the eighth aspect of the present invention, it is possible to easily and efficiently manufacture the aggregated channel switching unit that is good in compactness.

DESCRIPTION OF EMBODIMENTS

An air conditioning system 100, including an intermediate unit 130 according to an embodiment of the present invention, will be hereinafter explained with reference to drawings. It should be noted that the following embodiment is a specific example of the present invention, and is not intended to limit the technical scope of the present invention, and can be arbitrarily changed without departing from the scope of the present invention. Additionally, in the following embodiment, the directional terms "up", "down", "left", "right", "front (front side)" and "rear (back side)" mean directions depicted in FIGS. 5 to 15 and FIGS. 17 to 23.

(1) Air Conditioning System 100

Figure 1:
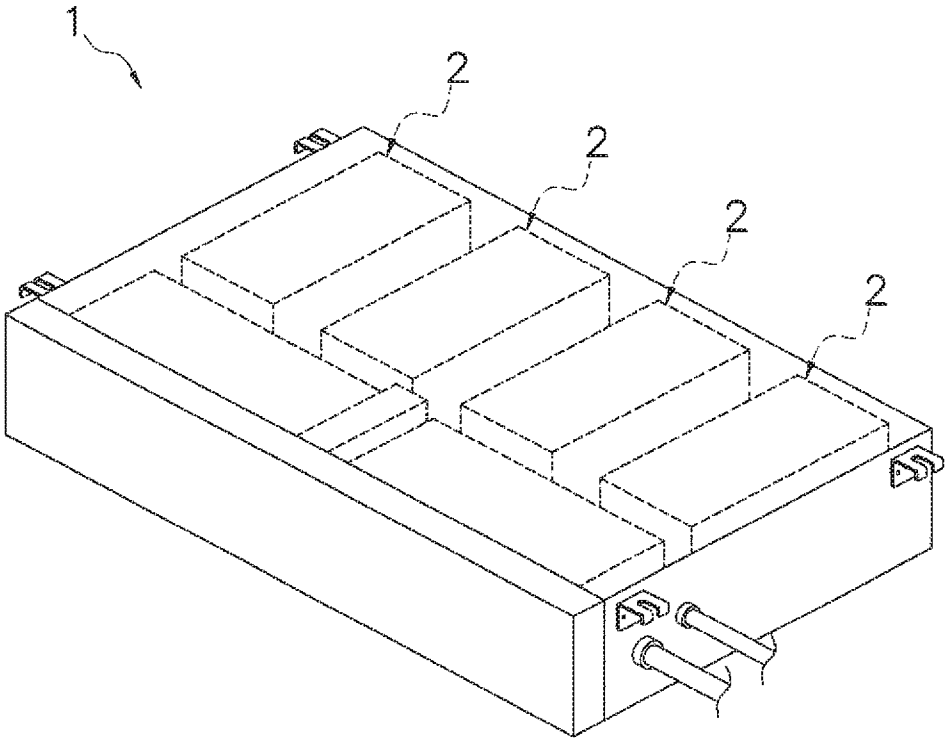
FIG. 1 is a perspective view of a conventional aggregated channel switching unit.
Figure 2:
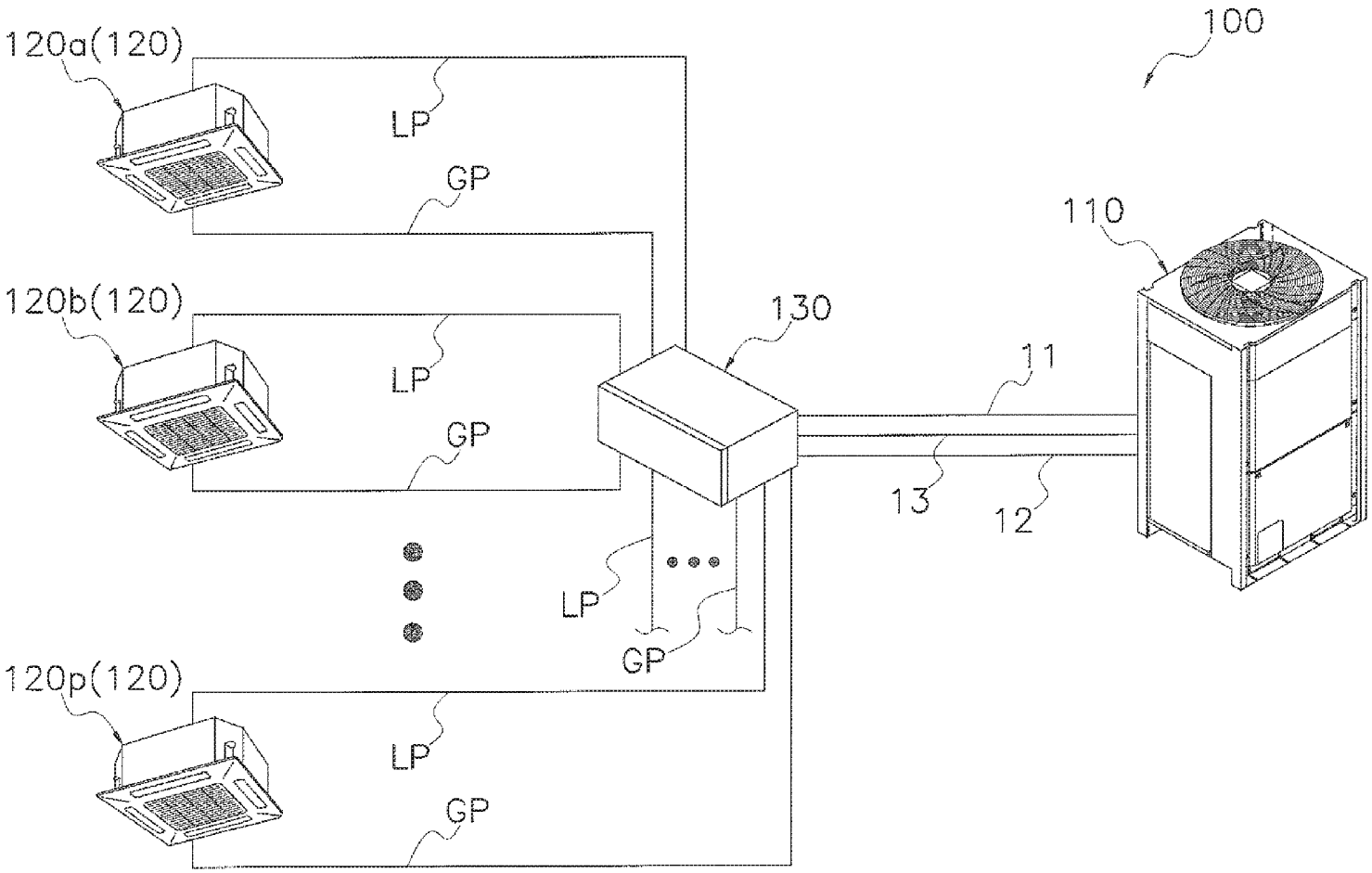
FIG. 2 is a diagram of an entire configuration of an air conditioning system including an intermediate unit according to an embodiment of the present invention.

FIG. 2 is a diagram of an entire configuration of the air conditioning system 100. The air conditioning system 100 is installed in a building, a factory or the like, and implements air conditioning in a target space. The air conditioning system 100, which is an air conditioning system of a refrigerant pipe type, is configured to perform a refrigeration cycle operation of a vapor compression type and performs cooling, heating or the like of the target space.

The air conditioning system 100 mainly includes a single outdoor unit 110 as a heat source unit, a plurality of indoor units 120 as utilization units, and the intermediate unit 130 (corresponds to "aggregated channel switching unit" described in claims) configured and arranged to switch a flow of refrigerant into the respective indoor units 120. Additionally, the air conditioning system 100 includes a liquid communicating pipe 11, a suction gas communicating pipe 12 and a high-low pressure gas communicating pipe 13 that connect the outdoor unit 110 and the intermediate unit 130, and a plurality of pairs of a liquid pipe LP and a gas pipe GP that connect the intermediate unit 130 and the indoor unit 120.

The air conditioning system 100 is configured to perform the refrigeration cycle operation that the refrigerant encapsulated in a refrigerant circuit is compressed, cooled or condensed, decompressed, heated or evaporated, and then, compressed again. It should be noted that the air conditioning system 100 is of a so-called cooling/heating free type that either a cooling operation or a heating operation is freely selectable in each of the indoor units 120.

The air conditioning system 100 will be hereinafter explained in detail.

(2) Detailed Explanation of Air Conditioning System 100

(2-1) Outdoor Unit 110

Figure 3:
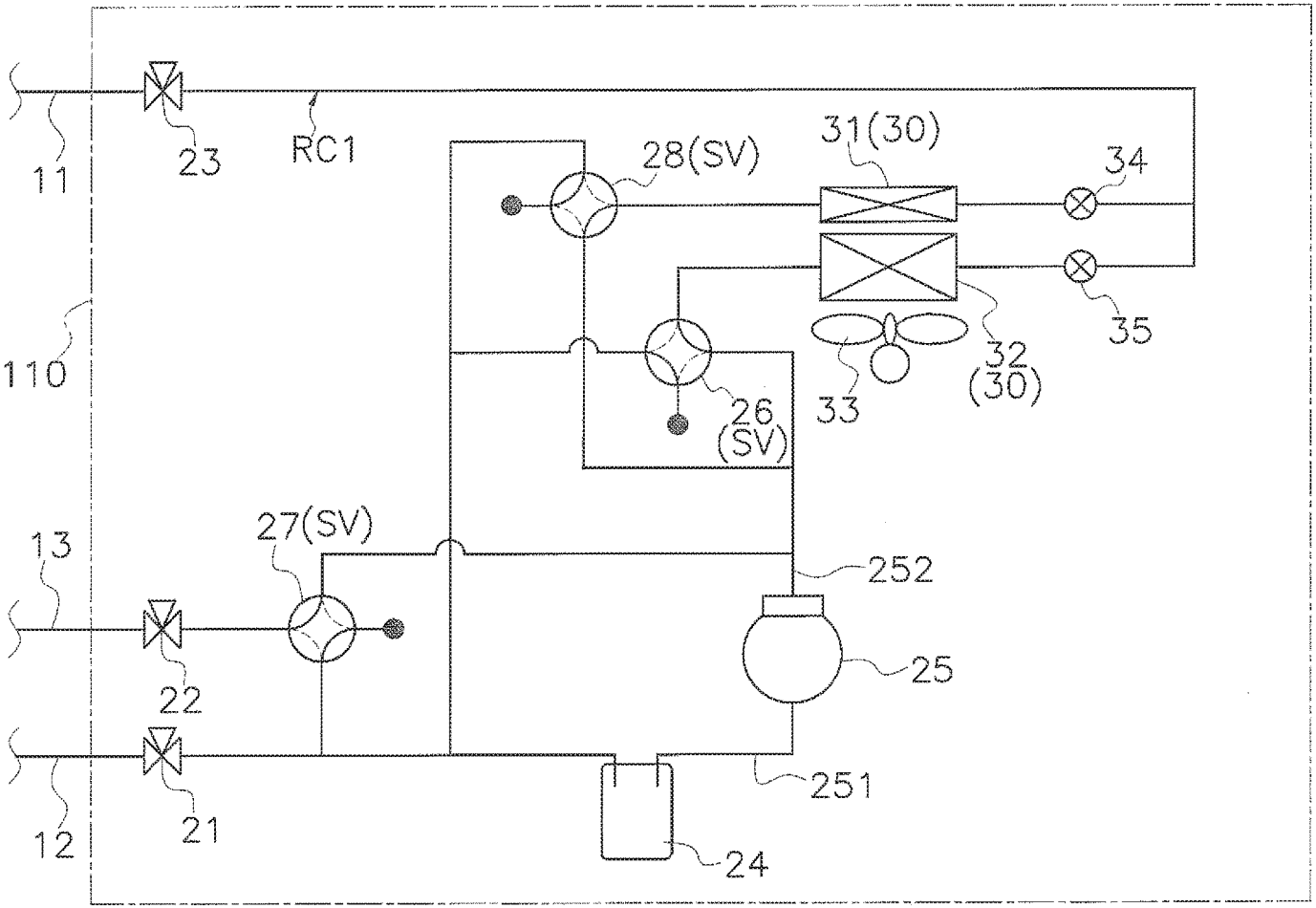
FIG. 3 is a diagram of a refrigerant circuit within an outdoor unit.

FIG. 3 is a diagram of a refrigerant circuit within the outdoor unit 110. The outdoor unit 110 is installed in an outdoor space (e.g., a roof or a veranda of a building) or a basement. A variety of machines are disposed within the outdoor unit 110 and are connected through refrigerant pipes, whereby a heat source-side refrigerant circuit RC1 is formed. The heat source-side refrigerant circuit RC1 is connected to gas refrigerant circuits RC3 (to be described later) and liquid refrigerant circuits RC4 (to be described later), which are provided within the intermediate unit 130, through the liquid communicating pipe 11, the suction gas communicating pipe 12 and the high-low pressure gas communicating pipe 13.

The heat source-side refrigerant circuit RC1 is formed by mainly connecting a first gas-side stop valve 21, a second gas-side stop valve 22, a liquid-side stop valve 23, an accumulator 24, a compressor 25, a first channel switch valve 26, a second channel switch valve 27, a third channel switch valve 28, an outdoor heat exchanger 30, a first outdoor expansion valve 34 and a second outdoor expansion valve 35 through a plurality of refrigerant pipes. Additionally, an outdoor fan 33, an outdoor unit controller (not shown in the drawings) and the like are disposed within the outdoor unit 110.

Machines designed to be disposed within the outdoor unit 110 will be hereinafter explained.

(2-1-1) First Gas-Side Stop Valve 21, Second Gas-Side Stop Valve 22 and Liquid-Side Stop Valve 23

The first gas-side stop valve 21, the second gas-side stop valve 22 and the liquid-side stop valve 23 are manual valves configured to be opened/closed in a refrigerant filling work, a pump-down work, or the like. The first gas-side stop valve 21 is connected at one end to the suction gas communicating pipe 12, and is also connected at the other end to the refrigerant pipe extending to the accumulator 24. The second gas-side stop valve 22 is connected at one end to the high-low pressure gas communicating pipe 13, and is also connected at the other end to the refrigerant pipe extending to the second channel switch valve 27. The liquid-side stop valve 23 is connected at one end to the liquid communicating pipe 11, and is also connected at the other end to the refrigerant pipe extending to either the first outdoor expansion valve 34 or the second outdoor expansion valve 35.

(2-1-2) Accumulator 24

The accumulator 24 is a container for temporarily accumulating the refrigerant at low pressure to be sucked into the compressor 25 and performing gas-liquid separation for the refrigerant. In the interior of the accumulator 24, the refrigerant in a gas-liquid dual-phase state is separated into the gas refrigerant and the liquid refrigerant. The accumulator 24 is disposed between the first gas-side stop valve 21 and the compressor 25. The refrigerant pipe extending from the first gas-side stop valve 21 is connected to a refrigerant inlet of the accumulator 24. A suction pipe 251 extending to the compressor 25 is connected to a refrigerant outlet of the accumulator 24.

(2-1-3) Compressor 25

The compressor 25 has a sealed structure in which a compressor motor is embedded. The compressor 25 is a displacement compressor such as a scroll compressor or a rotary compressor. It should be noted that only one compressor 25 is provided in the present embodiment, however, the number of the compressors 25 is not limited to one, and two or more compressors 25 may be connected in parallel. The suction pipe 251 is connected to a suction port (not shown in the drawings) of the compressor 25. The compressor 25 is configured to suck the refrigerant at low pressure through the suction port, compress the sucked refrigerant, and then discharge the compressed refrigerant through a discharge port (not shown in the drawings). A discharge pipe 252 is connected to the discharge port of the compressor 25.

(2-1-4) First Channel Switch Valve 26, Second Channel Switch Valve 27 and Third Channel Switch Valve 28

The first channel switch valve 26, the second channel switch valve 27 and the third channel switch valve 28 (hereinafter collectively referred to as "channel switch valves SV") are four-way switch valves and are configured to switch the flow of the refrigerant in accordance with conditions (see solid line and broken line in FIG. 3). The discharge pipe 252 or branch pipes extending from the discharge pipe 252 are respectively connected to the refrigerant inlet of each channel switch valve SV. Additionally, each channel switch valve SV is configured to block the flow of the refrigerant in one of the refrigerant channels during operation and practically functions as a three-way valve.

(2-1-5) Outdoor Heat Exchanger 30 and Outdoor Fan 33

The outdoor heat exchanger 30 is a heat exchanger of a cross-fin type or a micro-channel type. The outdoor heat exchanger 30 includes a first heat exchange portion 31 and a second heat exchange portion 32. In the outdoor heat exchanger 30, the first heat exchange portion 31 is mounted to an upper position, whereas the second heat exchange portion 32 is mounted to a lower position than the first heat exchange portion 31.

The first heat exchange portion 31 is connected at one end to the refrigerant pipe that is connected to the third channel switch valve 28, and is also connected at the other end to the refrigerant pipe extending to the first outdoor expansion valve 34. The second heat exchange portion 32 is connected at one end to the refrigerant pipe that is connected to the first channel switch valve 26, and is also connected at the other end to the refrigerant pipe extending to the second outdoor expansion valve 35. The refrigerant passing through the first heat exchange portion 31 and that passing through the second heat exchange portion 32 are configured to exchange heat with airflow to be generated by the outdoor fan 33.

The outdoor fan 33 is a propeller fan, for instance, and is configured to be driven in conjunction with an outdoor fan motor (not shown in the drawings). When the outdoor fan 33 is driven, the airflow, which flows into the outdoor unit 110, passes through the outdoor heat exchanger 30, and flows out from the outdoor unit 110, is generated.

(2-1-6) First Outdoor Expansion Valve 34 and Second Outdoor Expansion Valve 35

Each of the first outdoor expansion valve 34 and the second outdoor expansion valve 35 is, for instance, an electric valve that its opening degree is adjustable. The first outdoor expansion valve 34 is connected at one end to the refrigerant pipe extending from the first heat exchange portion 31, and is also connected at the other end to the refrigerant pipe extending to the liquid-side stop valve 23. The second outdoor expansion valve 35 is connected at one end to the refrigerant pipe extending from the second heat exchange portion 32, and is also connected at the other end to the refrigerant pipe extending to the liquid-side stop valve 23. Each of the first outdoor expansion valve 34 and the second outdoor expansion valve 35 is configured to adjust its opening degree in accordance with conditions, and decompress the refrigerant passing through its interior in accordance with its opening degree.

(2-1-7) Outdoor Unit Controller

The outdoor unit controller is a microcomputer composed of a CPU, a memory and the like. The outdoor unit controller is configured to send/receive signals to/from indoor unit controllers (to be described later) and an intermediate unit controller 132 (to be described later) through communication lines (not shown in the drawings). In response to received signals and the like, the outdoor unit controller is configured to control activation/deactivation and the rotational speed of the compressor 25 and those of the outdoor fan 33 and is also configured to control opening/closing and opening degree adjustment of a variety of valves.

(2-2) Indoor Units 120

Figure 4:
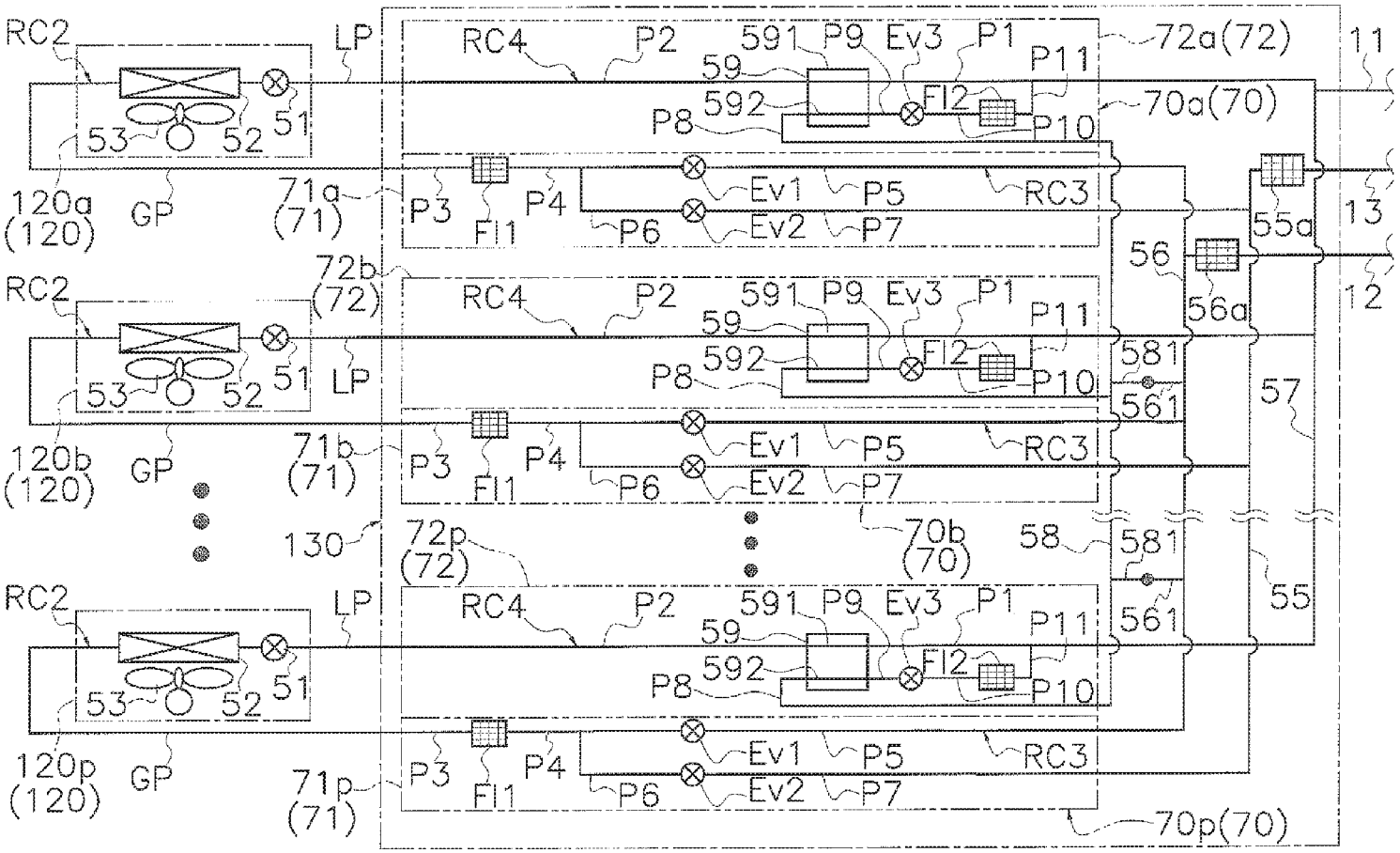
FIG. 4 is a diagram of refrigerant circuits within indoor units and the intermediate unit.

FIG. 4 is a diagram of refrigerant circuits within the indoor units 120 and the intermediate unit 130. Each of the indoor units 120 is of a so-called ceiling embedded type or a so-called ceiling suspended type that is installed in a space above the ceiling or the like, or alternatively, is of a wall mounted type that is mounted to the inner wall of an indoor space or the like. The air conditioning system 100 of the present embodiment includes the plural indoor units 120. Specifically, 16 sets of indoor units 120 (120*a* to 120*p*) are disposed therein.

A utilization-side refrigerant circuit RC2 is formed in each indoor unit 120. In each utilization-side refrigerant circuit RC2, an indoor expansion valve 51 and an indoor heat exchanger 52 are provided, and are connected to each other through a refrigerant pipe. Additionally, an indoor fan 53 and the indoor unit controller (not shown in the drawings) are disposed within each indoor unit 120.

The indoor expansion valve 51 is an electric valve that its opening degree is adjustable. The indoor expansion valve 51 is connected at one end to a relevant one of the liquid pipes LP, and is also connected at the other end to the refrigerant pipe extending to the indoor heat exchanger 52. The indoor expansion valve 51 is configured to decompress the refrigerant passing therethrough in accordance with its opening degree.

The indoor heat exchanger 52 is a heat exchanger of a cross-fin type or a micro-channel type, for instance, and includes a heat transfer tube (not shown in the drawings). The indoor heat exchanger 52 is connected at one end to the refrigerant pipe extending from the indoor expansion valve 51, and is also connected at the other end to a relevant one of the gas pipes GP. The refrigerant, flowing into the indoor heat exchanger 52, exchanges heat with airflow to be generated by the indoor fan 53 when passing through the heat transfer tube.

The indoor fan 53 is, for instance, a cross-flow fan or a sirocco fan. The indoor fan 53 is configured to be driven in conjunction with an indoor fan motor (not shown in the drawings). When the indoor fan 53 is driven, the airflow, which flows into the indoor unit 120 from an indoor space, passes through the indoor heat exchanger 52, and then flows out to the indoor space, is generated.

The indoor unit controller is a microcomputer composed of a CPU, a memory and the like. The indoor unit controller is configured to receive an instruction inputted by a user through a remote controller (not shown in the drawings) and drive the indoor fan 53 and the indoor expansion valve 51 in response to this instruction. Additionally, the indoor unit controller is connected to the outdoor unit controller and the intermediate unit controller 132 (to be described later) through a communication line (not shown in the drawings), and is configured to send/receive signals thereto/therefrom.

(2-3) Intermediate Unit 130

The intermediate unit 130 will be hereinafter explained. It should be noted that a method of manufacturing the intermediate unit 130 will be explained in "(5) Method of Manufacturing Intermediate Unit 130" to be described later.

Figure 5:
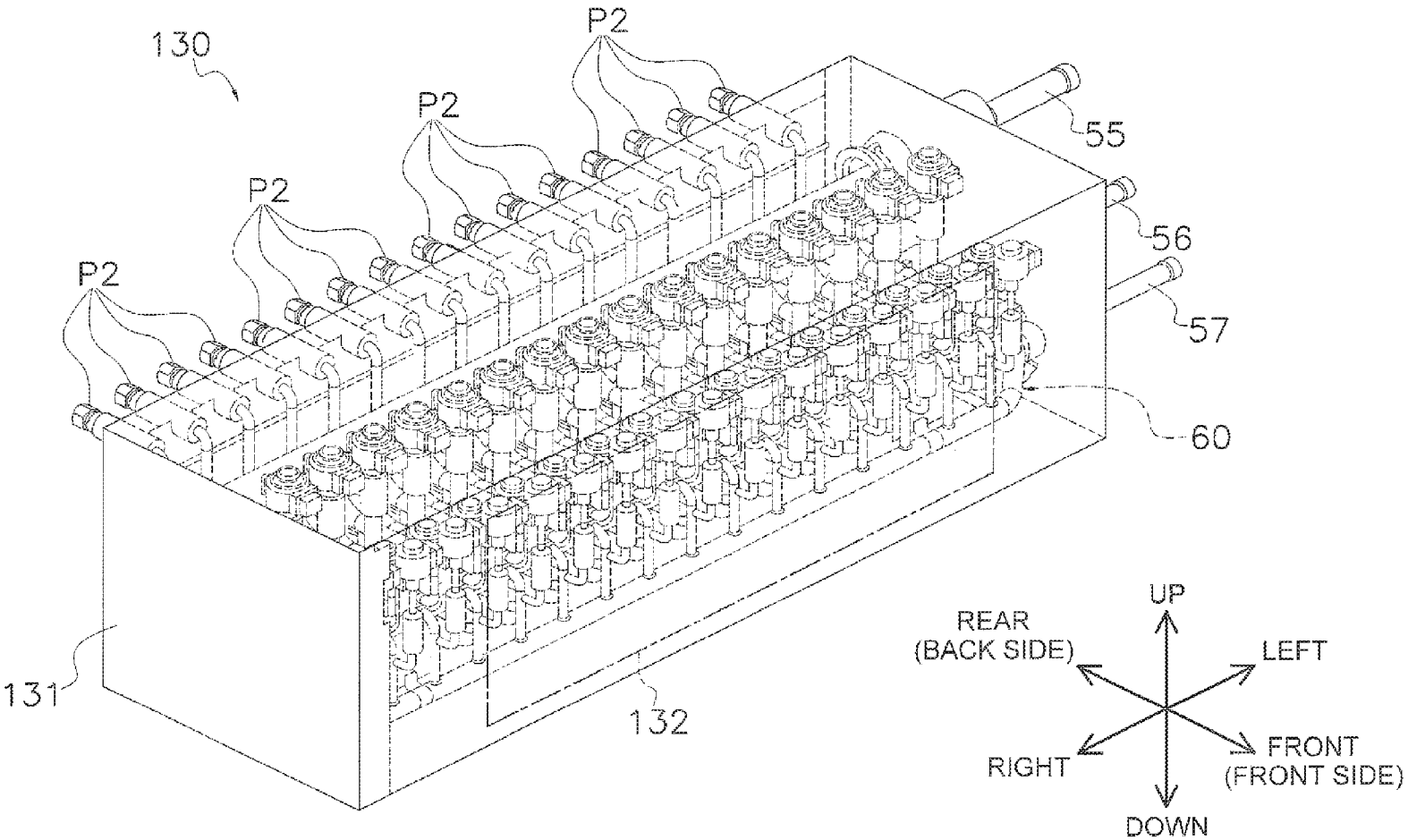
FIG. 5 is a perspective view of the intermediate unit.
Figure 6:
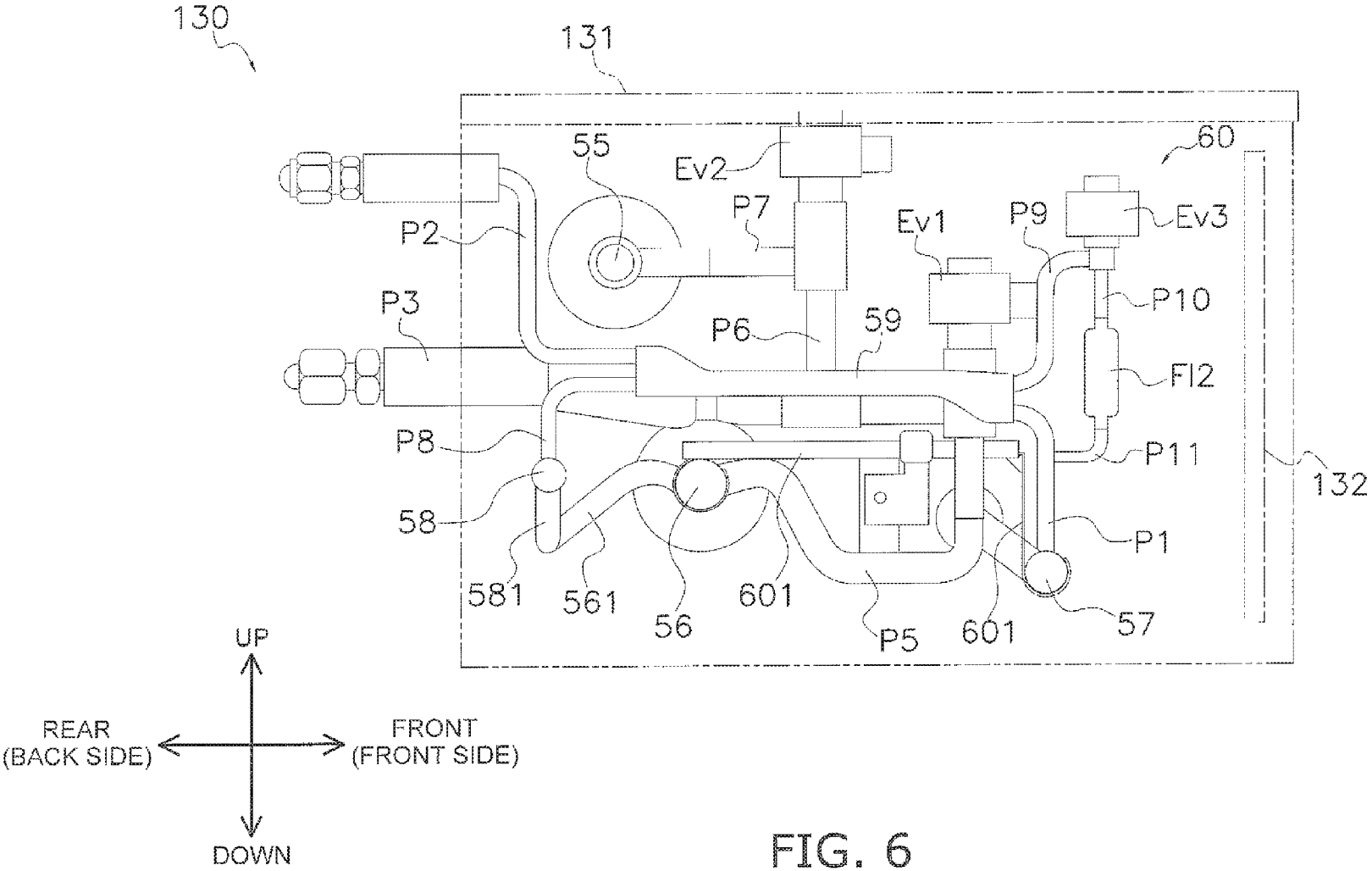
FIG. 6 is a right side view of the intermediate unit.
Figure 9:
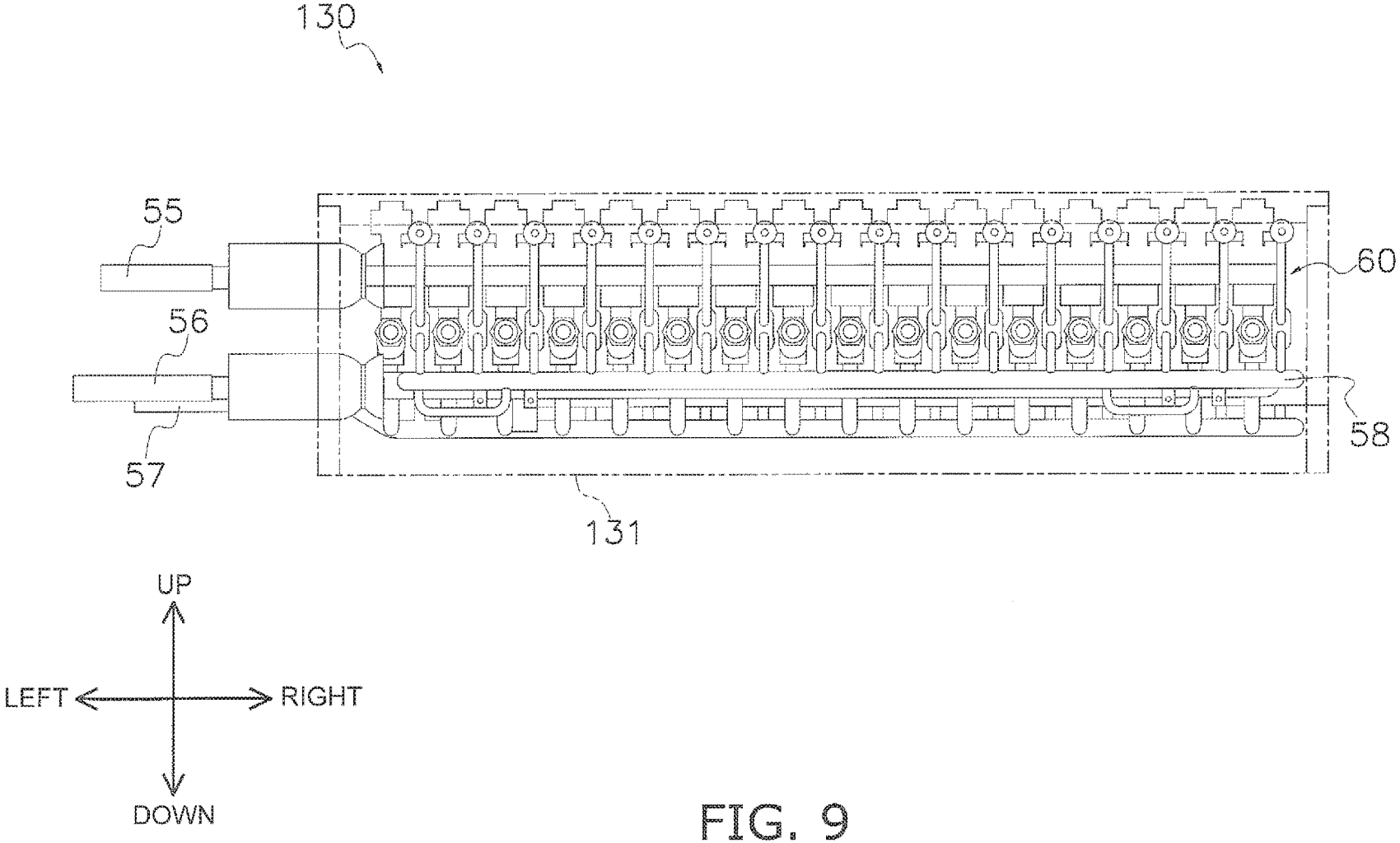
FIG. 9 is a rear view of the intermediate unit.
Figure 10:
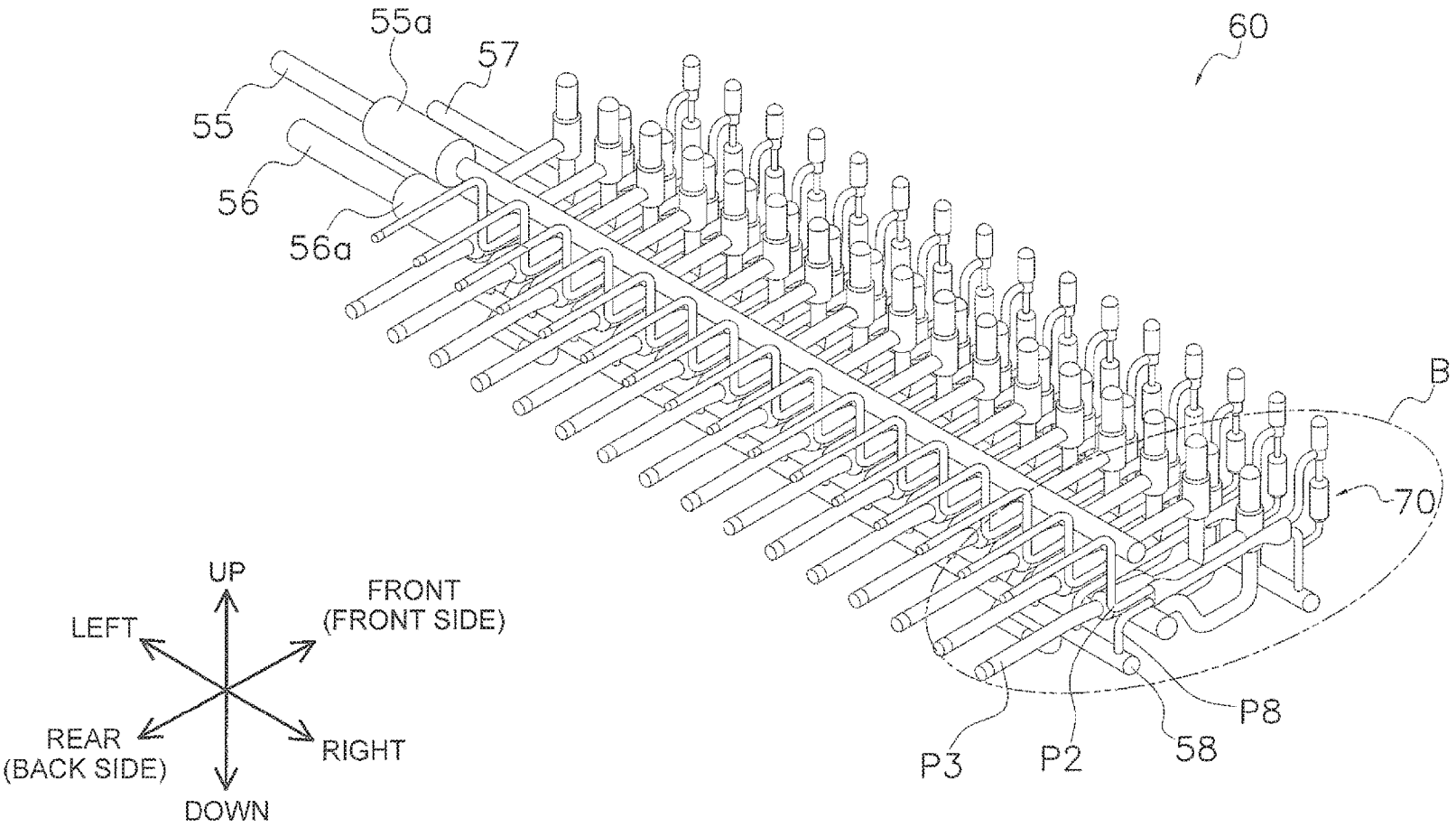
FIG. 10 is a perspective view of a BS unit assembly.

FIG. 5 is a perspective view of the intermediate unit 130. FIG. 6 is a right side view of the intermediate unit 130. MG. 7 is a top view of the intermediate unit 130. FIG: 8 is a front view of the intermediate unit 130. FIG. 9 is a rear view of the intermediate unit 130. FIG. 10 is a perspective view of a BS unit assembly 60.

The intermediate unit 130 is disposed between the outdoor unit 110 and the respective indoor units 120, and is configured and arranged to switch the flow of the refrigerant flowing into the outdoor unit 110 and the flow of the refrigerant flowing into each indoor unit 120. The intermediate unit 130 includes a casing 131 made of metal.

The casing 131 is made in an approximately cubical shape, and a drain pan (not shown in the drawings) is detachably mounted to the bottom of the casing 131. The casing 131 mainly accommodates the BS unit assembly 60 and the intermediate unit controller 132.

(2-3-1) BS Unit Assembly 60

Figure 11:
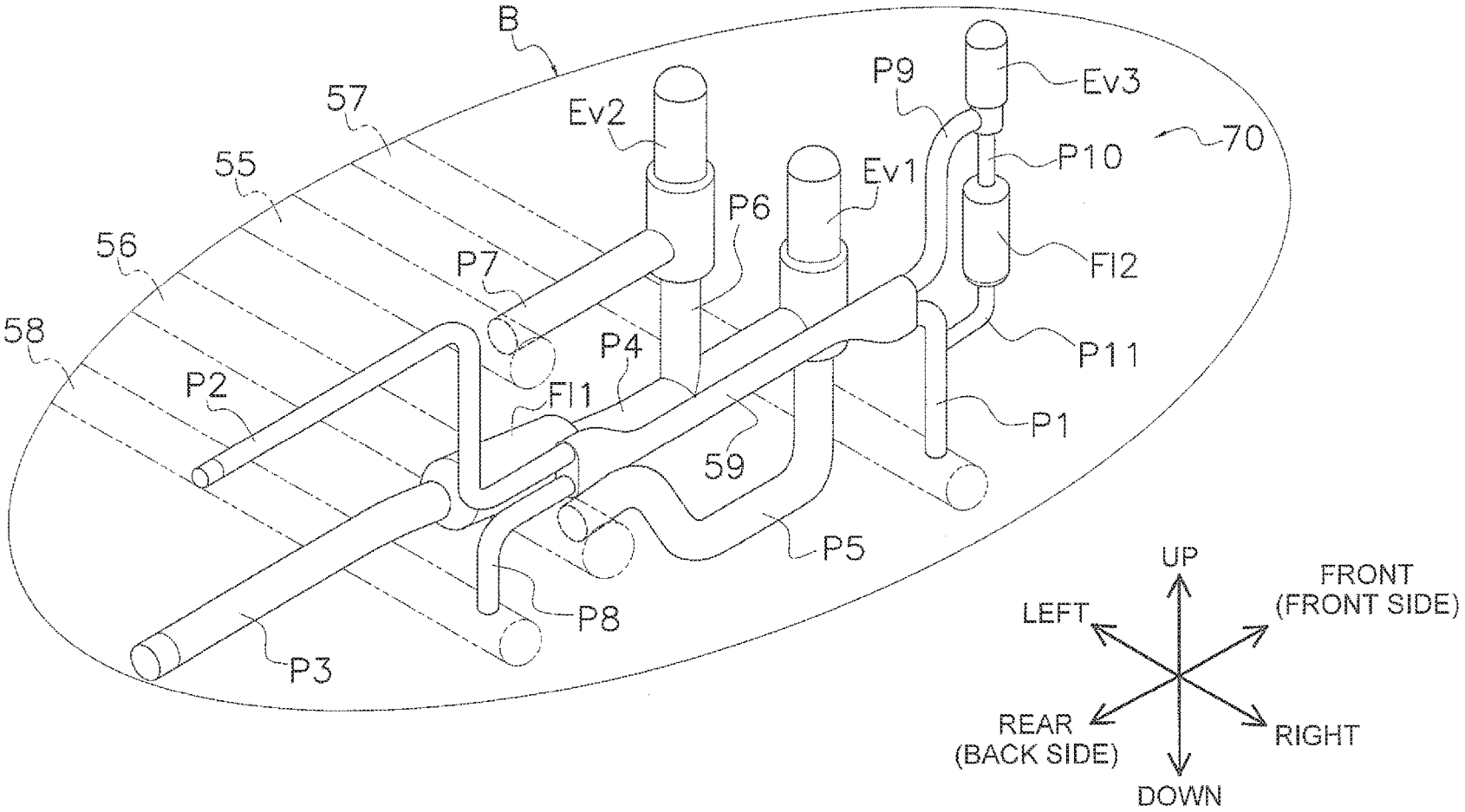
FIG. 11 is an enlarged view of a BS unit illustrated in a region B of FIG. 10.

As shown in FIG. 10, the BS unit assembly 60 is constructed by the combination of a plurality of refrigerant pipes, electric valves and the like. The BS unit assembly 60 is conceptually assembled by aggregating a plurality of BS units 70, each of which is shown in FIG. 11. In the present embodiment, as shown in FIG. 4 and the like, the BS unit assembly 60 includes a plurality of headers (a first header 55, a second header 56, a third header 57 and a fourth header 58). Also, the BS unit assembly 60 includes BS units 70 (specifically, the BS units 70*a* to 70*p*), the number of which is the same as that of the indoor units 120.

(2-3-1-1) First Header 55, Second Header 56, Third Header 57 and Fourth Header 58

The first header 55 is connected to and communicated with the high-low pressure gas communicating pipe 13. The first header 55 includes a first header filter 55*a* in the vicinity of its connected part to the high-low pressure gas communicating pipe 13. The first header filter 55*a* is configured and arranged to remove foreign objects (impurities) contained in the refrigerant passing therethrough. The first header 55 is connected approximately perpendicularly to a seventh pipe P7 of each first unit 71 to be described later.

The second header 56 is connected to and communicated with the suction gas communicating pipe 12. The second header 56 includes a second header filter 56*a* in the vicinity of its connected part to the suction gas communicating pipe 12. The second header filter 56*a* is configured and arranged to remove foreign objects (impurities) contained in the refrigerant passing therethrough. Additionally, the second header 56 is connected approximately perpendicularly to a fifth pipe P5 of each first unit 71 to be described later. Moreover, the second header 56 includes first connecting parts 561 (corresponding to "first part" described in claims) located right and left. The first connecting parts 561 are connected to second connecting parts 581 (to be described later) of the fourth header 58. The second header 56 is communicated with the fourth header 58 through the first connecting parts 561.

The third header 57 is connected to and communicated with the liquid communicating pipe 11. The third header 57 is connected approximately perpendicularly to a first pipe P1 of each liquid communicating unit 73 to be described later.

The fourth header 58 is connected approximately perpendicularly to an eighth pipe P8 of each bypass unit 74 to be described later. Additionally, the fourth header 58 includes the second connecting parts 581 (corresponding to "second part" described in claims) located right and left. The second connecting parts 581 are connected to the first connecting parts 561 of the second header 56. The fourth header 58 is communicated with the second header 56 through the second connecting parts 581.

The first header 55, the second header 56, the third header 57 and the fourth header 58 extend along the right-and-left direction (horizontal direction). The first header 55, the second header 56 and the third header 57 are exposed to the outside via through holes bored in the left lateral surface of the casing 131. Additionally, regarding the positional relation among the headers in the height direction, the first header 55, the fourth header 58, the second header 56 and the third header 57 are aligned from top to bottom in this sequential order (see FIG. 6). On the other hand, regarding the positional relation among the headers in the back-and-forth direction, the fourth header 58, the first header 55, the second header 56 and the third header 57 are aligned in this sequential order from the back side to the front side (see FIG. 6).

It should be noted that the first header 55, the second header 56, the third header 57 and the fourth header 58 extend in approximately parallel to each other. In other words, each header is disposed in a posture that each header tilts with respect to a straight line extending in parallel to its adjacent header at an angle of less than 10 degrees.

Figure 22:
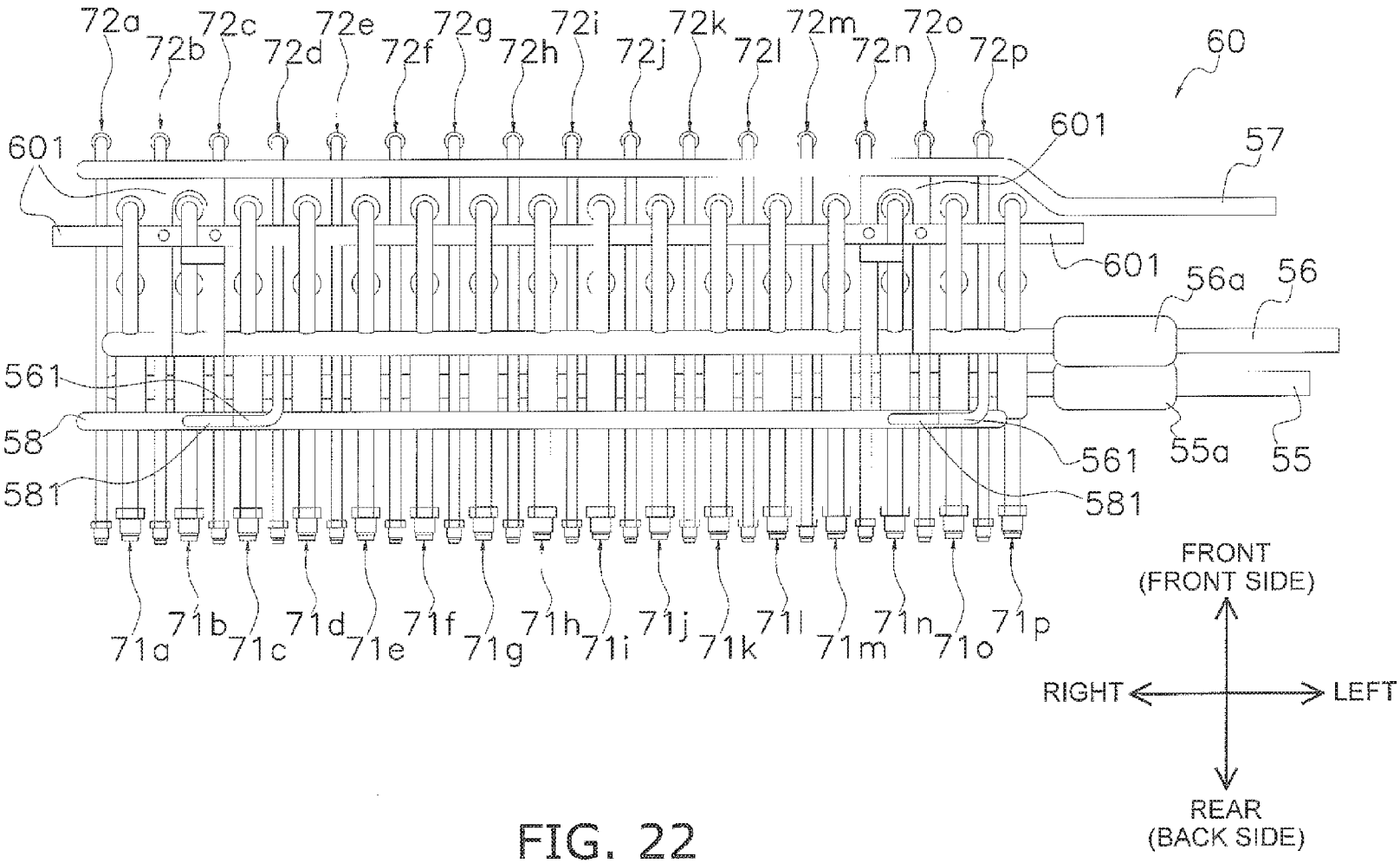
FIG. 22 is a bottom view of the first and second assemblies in an integrated condition.

Each first connecting part 561 of the second header 56 extends from the second header 56 along the hack-and-forth direction (i.e., a direction intersecting with the extending direction of the fourth header 58), then curves and extends in the right-and-left direction (i.e., a direction in parallel to the extending direction of the fourth header 58), and is connected to each second connecting part 581 (see FIGS. 6 and 22). In other words, each first connecting part 561 extends approximately in parallel to the extending direction of the fourth header 58 at its connected part to each second connecting part 581.

Additionally, each first connecting part 561 gently extends upward from the second header 56, and then curves and extends downward (see FIG. 6). The first connecting part 561 thus upwardly extends partially from the second header 56 in order to form a trap for inhibiting the refrigerant existing in the second header 56 and the refrigeration lubricant compatibly mixed with the refrigerant from flowing into the first connecting part 561 in a situation such as deactivation of the air conditioning system 100.

Each second connecting part 581 of the fourth header 58 extends from the fourth header 58 along the up-and-down direction (vertical direction), then curves and extends in the right-and-I ell direction (i.e., a direction in parallel to the extending direction of the fourth header 58), and is connected to each first connecting part 561 (see FIGS. 6 and 22).

(2-3-1-2) BS Units 70

Each BS units 70 are associated with any of the indoor units 120 on a one-to-one basis. For example, the BS unit 70*a* is associated with the indoor unit 120*a*. the BS unit 70*b* is associated with the indoor unit 120*b*. and the BS unit 70*p* is associated with the indoor unit 120*p*. Each BS unit 70 will be explained in detail in "(3) Detailed Explanation of BS Unit 70" to be described later.

(2-3-2) Intermediate Unit Controller 132

The intermediate unit controller 132 is a microcomputer composed of a CPU, a memory and the like. The intermediate unit controller 132 is configured to receive a signal from either each indoor unit controller or the outdoor unit controller through the communication line and control opening/closing of each of a first electric valve Ev1 (to be described later), a second electric valve Ev2 (to be described later) and a third electric valve Ev3 (to be described later) in accordance with this signal.

(3) Detailed Explanation of BS Unit 70

Each BS unit 70 will be hereinafter explained in detail. FIG. 11 is an enlarged view of each BS unit 70 shown in a region B of FIG. 10. Each BS unit 70 is mainly composed of the first unit 71 shown in FIG. 12 and a second unit 72 shown in FIG. 13.

(3-1) First Unit 71

Figure 12:
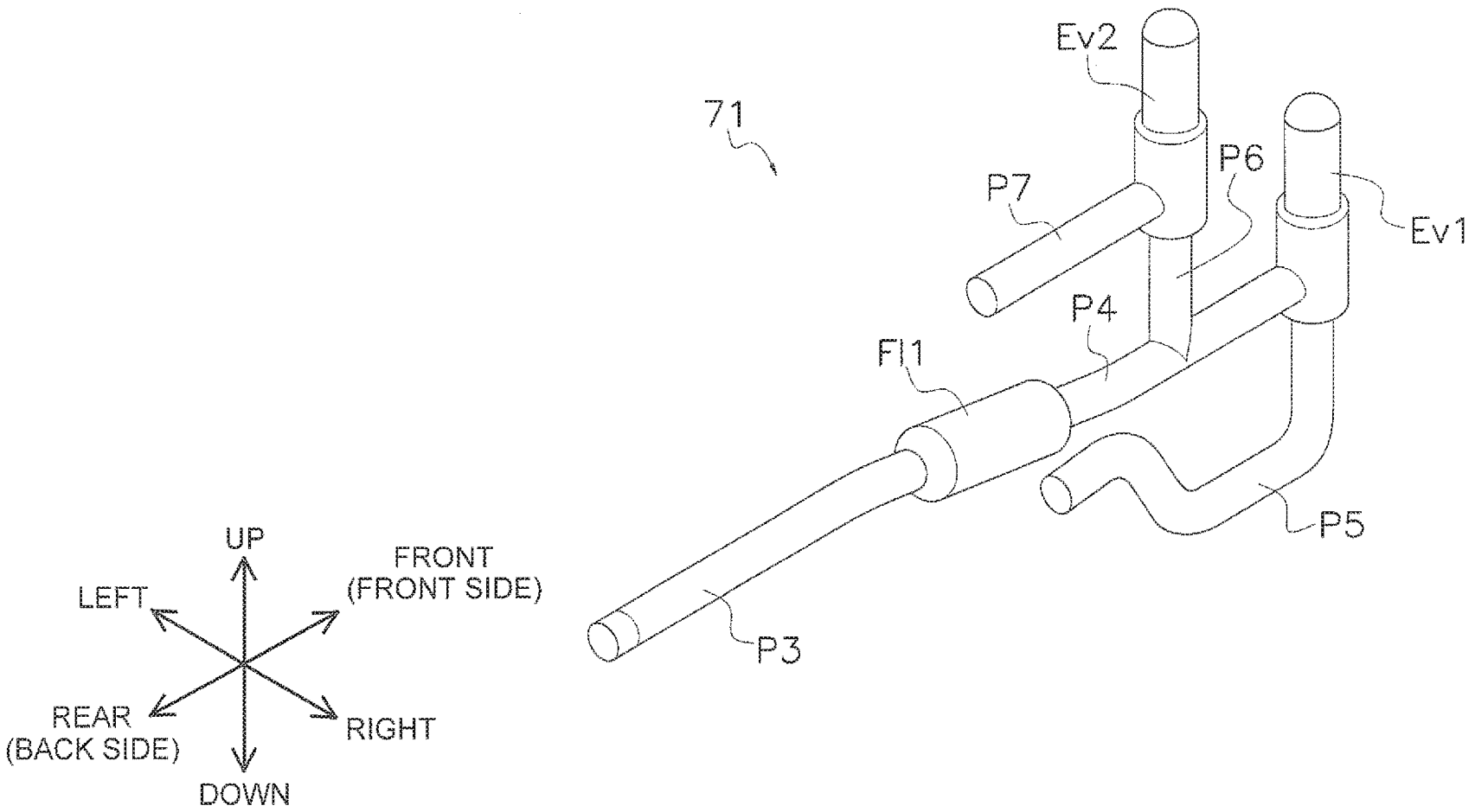
FIG. 12 is a perspective view of a first unit.

FIG. 12 is a perspective view of the first unit 71. The first unit 71 is a unit composing the gas refrigerant circuit RC3 within the BS unit 70.

The first unit 71 is connected to the high-low pressure gas communicating pipe 13 through the first header 55, is connected to the suction gas communicating pipe 12 through the second header 56, and is connected to its relevant utilization-side refrigerant circuit RC2 through its relevant gas pipe GP in other words, the first unit 71 is a refrigerant pipe unit mainly configured to cause the gas refrigerant to flow between either the high-low pressure gas communicating pipe 13 or the suction gas communicating pipe 12 and its relevant utilization-side refrigerant circuit RC2. From another perspective of view, the first unit 71 can be regarded as a single refrigerant pipe connecting between either the suction gas communicating pipe 12 or the high-low pressure gas communicating pipe 13 and its relevant utilization-side refrigerant circuit RC2 (i.e., the first unit 71 corresponds to "first refrigerant pipe" described in claims).

The first unit 71 mainly includes the first electric valve Ev1, the second electric valve Ev2, a first filter Fl1. Also, the first unit 71 includes, as refrigerant pipes, a third pipe P3, a fourth pipe P4, the fifth pipe P5, a sixth pipe P6 and the seventh pipe P7

(3-1-1) First Electric Valve Ev1 and Second Electric Valve Ev2

The first electric valve Ev1 (corresponding to "first switch valve" described in claims) is an electric valve that its opening degree is adjustable, for instance, and is configured to allow or block passage of the refrigerant in accordance with its opening degree in order to switch the flow of the refrigerant.

The second electric valve Ev2 (corresponding to "second switch valve" described in claims) is, for instance, an electric valve that its opening degree is adjustable. More specifically, the second electric valve Ev2 includes a minute channel (not shown in the drawings) in its interior, and enables the refrigerant to flow through the minute channel even when its opening degree is minimized. Thus, the second electric valve Ev2 is configured not to be completely closed even when its opening degree is minimized.

As shown in FIG. 12 (a drive part of the first electric valve Ev1 and that of the second electric valve Ev2 are not shown in FIG. 12), each of the first electric valve Ev1 and the second electric valve Ev2 is made in an approximately columnar shape, and is disposed in a posture that its lengthwise direction is oriented in the up-and-down direction (vertical direction). Specifically, the first electric valve Ev1 is connected at one end to the fourth pipe P4, and is also connected at the other end to the fifth pipe P5. On the other hand, the second electric valve Ev2 is connected at one end to the sixth pipe P6, and is also connected at the other end to the seventh pipe P7.

(3-1-2) First Filter Fl1

The first filter Fl1 (corresponding to "refrigerant pipe filter" described in claims) plays a role of removing foreign objects (impurities) contained in the refrigerant passing therethrough. As shown in FIG. 12, the first filter Fl1 is made in an approximately columnar shape, and is disposed in a posture that its lengthwise direction is oriented in the back-and-forth direction (horizontal direction). Specifically, the first filter Fl1 is connected at one end to the third pipe P3, and is also connected at the other end to the fourth pipe P4.

(3-1-3) Refrigerant Pipes within First Unit 71

The third pipe P3 is connected at one end to its relevant gas pipe GP, and is also connected at the other end to the first filter Fl1. Specifically, as shown in FIG. 11 and 12, the third pipe P3 extends rearward (horizontally) from the other end (i.e., its connected part to the first filter Fl1). It should be noted that the one end of the third pipe P3 is exposed to the outside from the hack side of the casing 131 (see FIGS. 6 and 7).

The fourth pipe P4 is connected at one end to the first filter Fl1, and is also connected at the other end to the first electric valve Ev1. Specifically, the fourth pipe P4 forwardly (horizontally) extends from the one end (its connected part to the first filter Fl1) and is connected at the other end to the first electric valve Ev1 (see FIGS. 11 and 12).

The fifth pipe P5 is connected at one end to the second header 56, and is also connected at the other end to the first electric valve Ev1. Specifically, the fifth pipe P5 gently extends upward from the one end (i.e., its connected part to the second header 56), then curves and extends downward, further curves and extends forward (horizontally), yet further curves and extends upward (vertically), and is connected at the other end to the first electric valve Ev1 (see FIGS. 6, 11 and 12). The fifth pipe P5 thus upwardly extends partially from its connected part to the second header 56 in order to form a trap for inhibiting the refrigerant existing in the second header 56 and the refrigeration lubricant compatibly mixed with the refrigerant from flowing into the fifth pipe P5 in a situation such as deactivation of the air conditioning system 100. It should be noted that the fifth pipe P5 is connected approximately perpendicularly to the second header 56. In other words, the one end of the fifth pipe P5 tilts with respect to a line perpendicular to the second header 56 at an angle of less than 10 degrees.

The sixth pipe P6 is connected at one end to the fourth pipe P4, and is also connected at the other end to the second electric valve Ev2. Specifically, the sixth pipe P6 upwardly (vertically) extends from the one end (i.e., its connected part to the fourth pipe P4) and is connected at the other end to the second electric valve Ev2 (see FIGS. 11 and 12).

The seventh pipe P7 is connected at one end to the second electric valve Ev2, and is also connected at the other end to the first header 55. Specifically, the seventh pipe P7 extends rearward (horizontally) from the one end (i.e., its connected part to the second electric valve Ev2) and is connected at the other end to the first header 55 (see FIGS. 11 and 12). It should be noted that the seventh pipe P7 is connected approximately perpendicularly to the first header 55. In other words, the other end of the seventh pipe P7 tilts with respect to a line perpendicular to the first header 55 at an angle of less than 10 degrees.

(3-2) Second Unit 72

Figure 13:
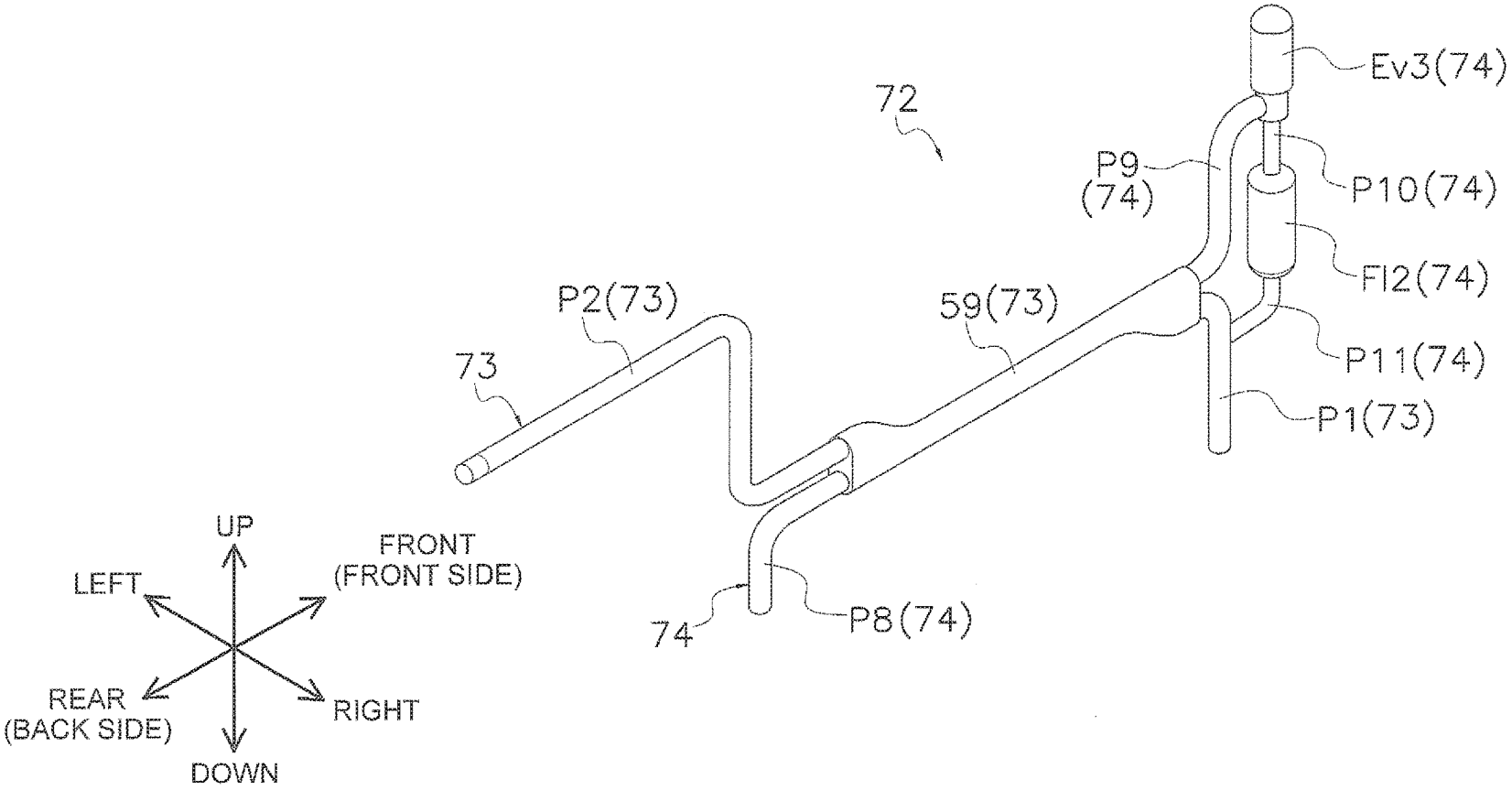
FIG. 13 is a perspective view of a second unit.

FIG. 13 is a perspective view of the second unit 72. The second unit 72 is further divided into the liquid communicating unit 73 and the bypass unit 74.

(3-2-1) Liquid Communicating Unit 73

The liquid communicating unit 73 is a unit for composing the liquid refrigerant circuit RC4 within each BS unit 70.

The liquid communicating unit 73 is connected to the liquid communicating pipe 11 through the third header 57, and is also connected to its relevant utilization-side refrigerant circuit RC2 through its relevant liquid pipe LP. In other words, the liquid communicating unit 73 is a refrigerant pipe unit that mainly causes the liquid refrigerant to flow between the liquid communicating pipe 11 and its relevant utilization-side refrigerant circuit RC2. From another perspective of view, the liquid communicating unit 73 can be regarded as a single refrigerant pipe connecting between the liquid communicating pipe 11 and its relevant utilization-side refrigerant circuit RC2 (i.e., the liquid communicating unit 73 corresponds to "second refrigerant pipe" described in claims).

The liquid communicating unit 73 mainly includes a supercooling heat exchange portion 59 and first and second pipes P1 and P2 as refrigerant pipes.

(3-2-1-1) Supercooling Heat Exchange Portion 59

The supercooling heat exchange portion 59 is, for instance, a heat exchanger of a two-nested-pipe type. The supercooling heat exchange portion 59 is made in an approximately tubular shape, and are formed a first channel 591 and a second channel 592 in the interior thereof More specifically, the supercooling heat exchange portion 59 has a structure that enables heat exchange between the refrigerant flowing through the first channel 591 and the refrigerant flowing through the second channel 592. Specifically, the first channel 591 is connected at one end to the first pipe P1, and is also connected at the other end to the second pipe P2. The second channel 592 is connected at one end to the eighth pipe P8, and is also connected at the other end to a ninth pipe P9.

The supercooling heat exchange portion 59 is disposed in a posture that it extends along the back-and-forth direction (horizontal direction). It should he noted that in the BS unit assembly 60, the supercooling heat exchange portion 59 extends in approximately parallel to the third pipe P3, the fourth pipe P4 and the like. In other words, the supercooling heat exchange portion 59 is disposed in an aspect that it tilts with respect to a straight line extending in parallel to constituent elements, such as the third pipe P3, the fourth pipe P4, disposed adjacently to the supercooling heat exchange portion 59 at an angle of less than 10 degrees.

(3-2-1-2) Refrigerant Pipes within Liquid Communicating unit 73

The first pipe P1 is connected at one end to the third header 57, and is also connected at the other end to the first channel 591 of the supercooling heat exchange portion 59. Specifically, the first pipe P1 upwardly (vertically) extends from the one end (i.e., its connected part to the third header 57) and is connected at the other end to the supercooling heat exchange portion 59 (see FIGS. 11 and 13). It should be noted that the first pipe P1 is connected approximately perpendicularly to the third header 57. In other words, the one end of the first pipe P1 tilts with respect to a line perpendicular to the third header 57 at an angle of less than 10 degrees.

The second pipe P2 is connected at one end to the first channel 591 of the supercooling heat exchange portion 59, and is also connected at the other end to its relevant liquid pipe LP. Specifically, as shown in FIGS. 11 and 13, the second pipe P2 extends rearward (horizontally) from the one end (i.e., its connected part to the supercooling heat exchange portion 59), then curves and extends upward (vertically), and further curves and extends rearward (horizontally). It should be noted that the other end of the second pipe P2 is exposed to the outside from the back side of the casing 131 (see FIGS. 5 to 7).

(3-2-2) Bypass Unit 74

The bypass unit 74 is a unit for bypassing the refrigerant from the fourth header 58 to the liquid communicating unit 73. Specifically, the bypass unit 74 is connected at one end to the fourth header 58, and is also connected at the other end to the first pipe P1 of the liquid communicating unit 73.

More specifically, the bypass unit 74 is a refrigerant pipe unit that bypasses the gas refrigerant, which has passed through the fifth pipe P5 of the first unit 71 and has then flown into the fourth header 58 through the second header 56, to the first pipe P1 of the liquid communicating unit 73. From another perspective of view, the bypass unit 74 can be regarded as a single bypass pipe that bypasses the refrigerant within the fourth header 58 to the liquid communicating unit 73. In other words, the bypass unit 74 corresponds to "bypass pipe" described in claims.

The bypass unit 74 mainly includes the third electric valve Ev3 corresponding to "third switch valve" described in claims), a second filter Fl2. Also, the bypass unit 74 includes, as refrigerant pipes, an eighth pipe P8, a ninth pipe P9, a tenth pipe P10 and a eleventh pipe P11.

(3-2-2-1) Third Electric Valve Ev3

The third electric valve Ev3 is, for instance, an electric valve that its opening degree is adjustable. The third electric valve Ev3 is capable of regulating the flow rate of the refrigerant in accordance with its opening degree, and is also configured to allow or block passage of the refrigerant in order to switch the flow of the refrigerant. As shown in FIG. 13 (a drive part of the third electric valve Ev3 is not shown in FIG. 13), the third electric valve Ev3 is made in an approximately columnar shape, and is disposed in a posture that its lengthwise direction is oriented in the up-and-down direction (vertical direction). Specifically, the third electric valve Ev3 is connected at one end to the ninth pipe P9, and is also connected at the other end to the tenth pipe P10.

(3-2-2-2) Second Filter Fl2

The second filter Fl2 plays a role of removing foreign objects (impurities) contained in the refrigerant passing therethrough. As shown in FIG. 13, the second filter Fl2 is made in an approximately columnar shape, and is disposed in a posture that its lengthwise direction is oriented in the up-and-down direction (vertical direction). Specifically, the second filter Fl2 is connected at one end to the tenth pipe P10, and is also connected at the other end to the eleventh pipe P11.

(3-2-2-3) Refrigerant Pipes within Bypass Unit 74

The eighth pipe P8 is connected at one end to the fourth header 58, and is also connected at the other end to the second channel 592 of the supercooling heat exchange portion 59. Specifically, the eighth pipe P8 upwardly (vertically) extends from the one end (i.e., its connected part to the fourth header 58), curves and extends forward (horizontally), and is connected to the supercooling heat exchange portion 59 (see FIGS. 11 and 13). It should be noted that the eighth pipe P8 is connected approximately perpendicularly to the fourth header 58. In other words, the one end of the eighth pipe P8 tilts with respect to a line perpendicular to the fourth header 58 at an angle of less than 10 degrees.

The ninth pipe P9 is connected at one end to the second channel 592 of the supercooling heat exchange portion 59, and is also connected at the other end to the third electric valve Ev3. Specifically, the ninth pipe P9 upwardly (vertically) extends from the one end (i.e., its connected part to the supercooling heat exchange portion 59), and is connected at the other end to the third electric valve Ev3 (see FIGS. 11 and 13).

The tenth pipe P10 is connected at one end to the third electric valve Ev3, and is also connected at the other end to the second filter Fl2. Specifically, the tenth pipe P10 downwardly (vertically) extends from its part connected to the third electric valve Ev3, and is connected at the other end to the second filter Fl2 (see FIGS. 11 and 13).

The eleventh pipe P11 is connected at one end to the second filter Fl2, and is also connected at the other end to the first pipe P1. Specifically, the eleventh pipe P11 downwardly (vertically) extends from the one end (i.e., its connected part to the second filter Fl2), curves and extends rearward (horizontally), and is connected at the other end to the first pipe P1 (see FIGS. 11 and 13).

(4) Refrigerant Flow during Operation of Air Conditioning System 100

Refrigerant flow during operation of the air conditioning system 100 will be hereinafter explained for various conditions in which the indoor units 120*a* and 120*b* are assumed to be under operation.

It should be noted that in the following explanation, the other indoor units 120 (120*c* to 120*p*) are assumed to be under deactivation in order to make explanation simple. Based on the above, the indoor expansion valves 51 in the indoor units 120 except for the indoor units 120*a* and 120*b* are assumed to be fully closed, and the first electric valves Ev1 and the third electric valves Ev3 in the BS units 70 (i.e., BS units 70*c* to 70*p*) except for the BS units 70*a* and 70*b* are assumed to be fully closed. Additionally, the second electric valves Ev2 in the BS units 70*c* to 70*p* are assumed to be opened at the minimum opening degree.

(4-1) Condition that Both of Indoor Units 120*a* and 120*b* Perform Cooling Operation Under this condition, in each of the BS units 70*a* and 70*b*. the first electric valve Ev1 is configured to be fully opened and the second electric valve Ev2 is configured to be opened at the minimum opening degree. Additionally, the indoor expansion valve 51 in each of the indoor units 120*a* and 120*b* is configured to be opened at an appropriate opening degree, and the first outdoor expansion valve 34 and the second outdoor expansion valve 35 are configured to be fully opened.

When the compressor 25 is driven under the aforementioned condition, the high-pressure gas refrigerant produced by compression of the compressor 25, flows into the outdoor heat exchanger 30 through the discharge pipe 252, the first channel switch valve 26, the third channel switch valve 28 and the like and condenses therein. The refrigerant, which has condensed in the outdoor heat exchanger 30, passes through the liquid-side stop valve 23 and the like, and flows into the liquid communicating pipe 11. The refrigerant, which has flown into the liquid communicating pipe 11, reaches the third header 57 of the intermediate unit 130 in due course, and flows into the first pipe P1 of the BS unit 70*a* or 70*b* (the second unit 72*a* or 72*b*).

The refrigerant, which has flown into the first pipe P1, flows through the second pipe P2, the relevant liquid pipe LP and the like, reaches the indoor unit 120*a* or 120*b*. flows into the indoor expansion valve 51, and is decompressed therein. The decompressed refrigerant flows into each indoor heat exchanger 52 and evaporates therein. The evaporated refrigerant flows into the third pipe P3 of the BS unit 70*a* or 70*b* (the first unit 71*a* or 71*b*) through the gas pipe GP.

The refrigerant, which has flown into the third pipe P3, flows through the fourth pipe P4, the fifth pipe P5 and the like, and reaches the second header 56. The refrigerant, which has reached the second header 56, flows into the outdoor unit 110 through the suction gas communicating pipe 12 and is sucked into the compressor 25.

(4-2) Condition that Both of Indoor Units 120*a* and 120*b* Perform Heating Operation Under this condition, in each of the BS units 70*a* and 70*b*. the first electric valve Ev1 is configured to be fully closed, whereas the second electric valve Ev2 is configured to be fully opened. Additionally, the indoor expansion valve 51 in each of the indoor units 120*a* and 120*b* is configured to be filly opened, and each of the first outdoor expansion valve 34 and the second outdoor expansion valve 35 is configured to be opened at an appropriate opening degree.

When the compressor 25 is driven under the aforementioned condition, the high-pressure gas refrigerant produced by compression of the compressor 25, flows into the high-low pressure gas communicating pipe 13 through the discharge pipe 252, the second channel switch valve 27 and the like. The refrigerant, which has flown into the high-low pressure gas communicating pipe 13, reaches the first header 55 of the intermediate unit 130 in due course. The refrigerant, which has reached the first header 55, flows into the seventh pipe P7 of the BS unit 70*a* or 70*b* (the first unit 71*a* or 71*b*) and then flows into the gas pipe OP through the sixth pipe P6, the fourth pipe P4, the third pipe P3 and the like.

The refrigerant, which has flown into the gas pipe GP, reaches the indoor unit 120*a* or 120*b*, flows into each indoor heat exchanger 52, and condenses therein. The condensed refrigerant flows into the second pipe P2 of the BS unit 70*a* or 70*b* (the second unit 72*a* or 72*b*) through the liquid pipe LP.

The refrigerant, which has flown into the second pipe P2, reaches the third header 57 through the first pipe P1 and the like. The refrigerant, which has reached the third header 57, flows into the outdoor unit 110 through the liquid communicating pipe 11.

The refrigerant, which has flown into the outdoor unit 110, is decompressed in the first outdoor expansion valve 34 or the second outdoor expansion valve 35. The decompressed refrigerant flows into the outdoor heat exchanger 30 and evaporates therein while passing through the outdoor heat exchanger 30. The evaporated refrigerant is sucked into the compressor 25 through the first channel switch valve 26 or the third channel switch valve 28 and the like.

(4-3) Condition that One Indoor Unit 120*a*/120*b* Performs Cooling Operation whereas other Indoor Unit 120*a*/201*b* Performs Heating Operation Under this condition, in one of the BS units 70*a* and 70*b* (hereinafter referred to as "one BS unit 70") associated with one of the indoor units 120 performing a cooling operation (hereinafter referred to as "one indoor unit 120"), the first electric valve E)/1 is configured to be fully opened, the second electric valve Ev2 is configured to be opened at the minimum opening degree, and the third electric valve Ev3 is configured to be opened at an appropriate opening degree. Additionally, in one indoor unit 120, the indoor expansion valve 51 is configured to be opened at an appropriate opening degree. In comparison with this, the other of the BS units 70*a* and 70*b* (hereinafter referred to as "the other BS unit 70") associated with the other of the indoor units 120 performing a heating operation (hereinafter referred to as "the other indoor unit 120"), the first electric valve Ev1 is configured to be fully closed and the second electric valve Ev2 is configured to be fully opened. Additionally, in the other indoor unit 120, the indoor expansion valve 51 is configured to be fully opened. Moreover, each of the first outdoor expansion valve 34 and the second outdoor expansion valve 35 is configured to be opened at an appropriate opening degree.

When the compressor 25 is driven under the aforementioned condition, the high-pressure gas refrigerant produced by compression of the compressor 25, flows into the high-low pressure gas communicating pipe 13 through the discharge pipe 252, the second channel switch valve 27 and the like. The refrigerant, which has flown into the high-low pressure gas communicating pipe 13, reaches the first header 55 of the intermediate unit 130 in due course. The refrigerant, which has reached the first header 55, flows into the first unit 71 in the other BS unit 70, and flows into the gas pipe GP through the seventh pipe P7, the sixth pipe P6, the fourth pipe P4, the third pipe P3 and the like.

The refrigerant, which has flown into the relevant gas pipe GP, reaches the other indoor unit 120, flows into the indoor heat exchanger 52, and condenses therein. The condensed refrigerant flows into the second pipe P2 of the liquid communicating unit 73 in the other BS unit 70 through the liquid pipe LP. The refrigerant, which has flown into the second pipe P2, reaches the third header 57 through the first pipe P1 and the like.

The refrigerant, which has reached the third header 57, reaches the liquid communicating unit 73 in the one BS unit 70 and flows into the first pipe P1. The reftigerant, which has flown into the first pipe P1, passes through the first channel 591 of the supercooling heat exchange portion 59 and reaches the one indoor unit 120 through the second pipe P2 and the liquid pipe LP.

The refrigerant, which has reached the one indoor unit 120, flows into the indoor expansion valve 51 and is decompressed therein. The decompressed refrigerant flows into the indoor heat exchanger 52 and evaporates therein. The evaporated refrigerant reaches the first unit 71 of the one BS unit 70 through the gas pipe GP and flows into the third pipe P3. The refrigerant, which has flown into the third pipe P3, flows through the fourth pipe P4, the fifth pipe P5 and the like, and reaches the second header 56.

Part of the refrigerant having reached the second header 56 flows into the outdoor unit 110 through the suction gas communicating pipe 12 and is sucked into the compressor 25. On the other hand, the rest of the refrigerant having reached the second header 56 flows into the fourth header 58 through the first connecting part 561 and the second connecting part 581. In other words, the first connecting part 561 and the second connecting part 581 correspond to "connecting pipes" that connect the second header 56 and the fourth header 58 and feed the refrigerant within the second header 56 to the fourth header 58.

The refrigerant, which has flown into the fourth header 58, reaches the bypass unit 74 in the one BS unit 70 and flows into the eighth pipe P8. The refrigerant, which has flown into the eighth pipe P8, flows into the second channel 592 of the supercooling heat exchange portion 59. The refrigerant, which has flown into the second channel 592, exchanges heat with the refrigerant passing through the first channel 591 when passing through the second channel 592, whereby the refrigerant passing through the first channel 591 is cooled. Accordingly, the refrigerant flowing through the first channel 591 is in a supercooled state.

The refrigerant, which has passed through the second channel 592, flows through the ninth pipe P9, the tenth pipe P10, the eleventh pipe P11 and the like, and joins the refrigerant flowing through the first pipe P1.

(5) Method of Manufacturing Intermediate Unit 130

A method of manufacturing the intermediate unit 130 will be hereinafter explained.

The intermediate unit 130 is mainly manufactured by combining separately fabricated components, including the casing 131, the intermediate unit controller 132 and the BS unit assembly 60, in a production line. Specifically, the BS unit assembly 60 is mounted onto the bottom side of the casing 131 manufactured by sheet metal working, and is suitably fixed thereto by screws and the like. Afterwards, the intermediate unit controller 132 is accommodated in the casing 131, and wiring, connection and the like are performed between the intermediate unit controller 132 and the first, second and third electric valves Ev1, Ev2 and Ev3. Finally, a drain pan and the like are mounted to the casing 131, and then, the top side and the front side part of the casing 131 are fixed to the casing 131 by screws and the like.

Figure 14:
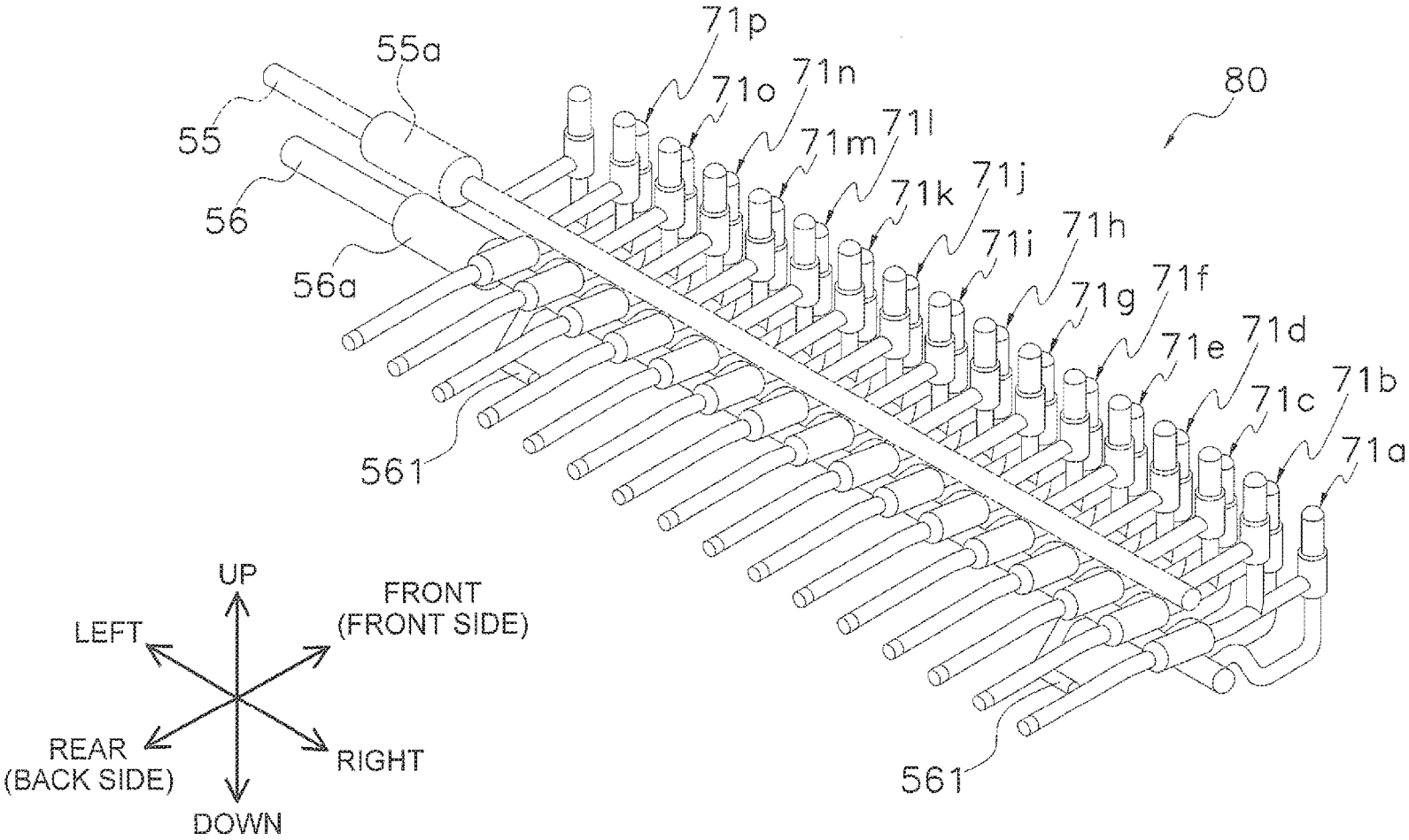
FIG. 14 is a perspective view of a first assembly.
Figure 15:
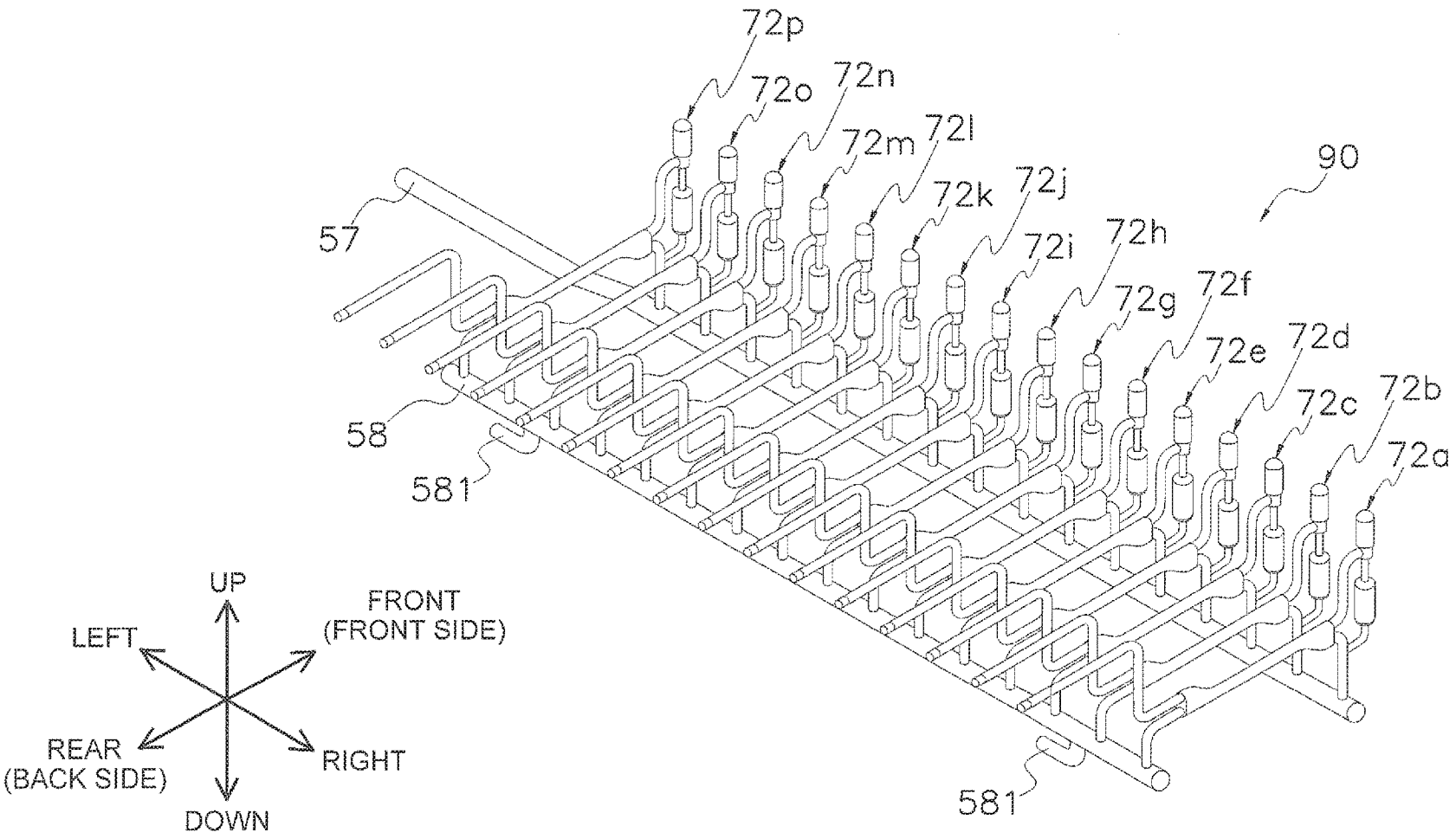
FIG. 15 is a perspective view of a second assembly.
Figure 16:
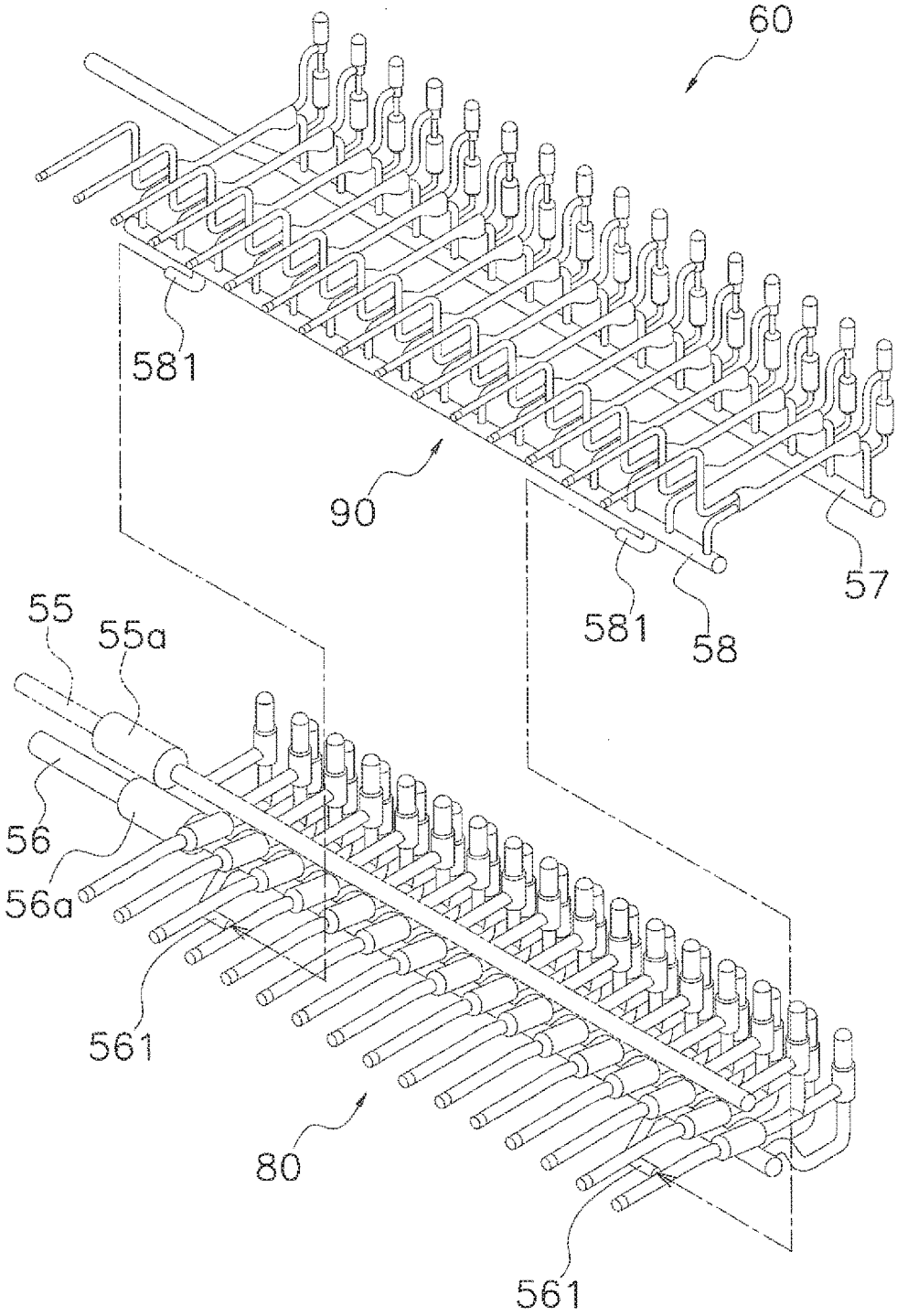
FIG. 16 is an exploded view of the BS unit assembly.
Figure 23:
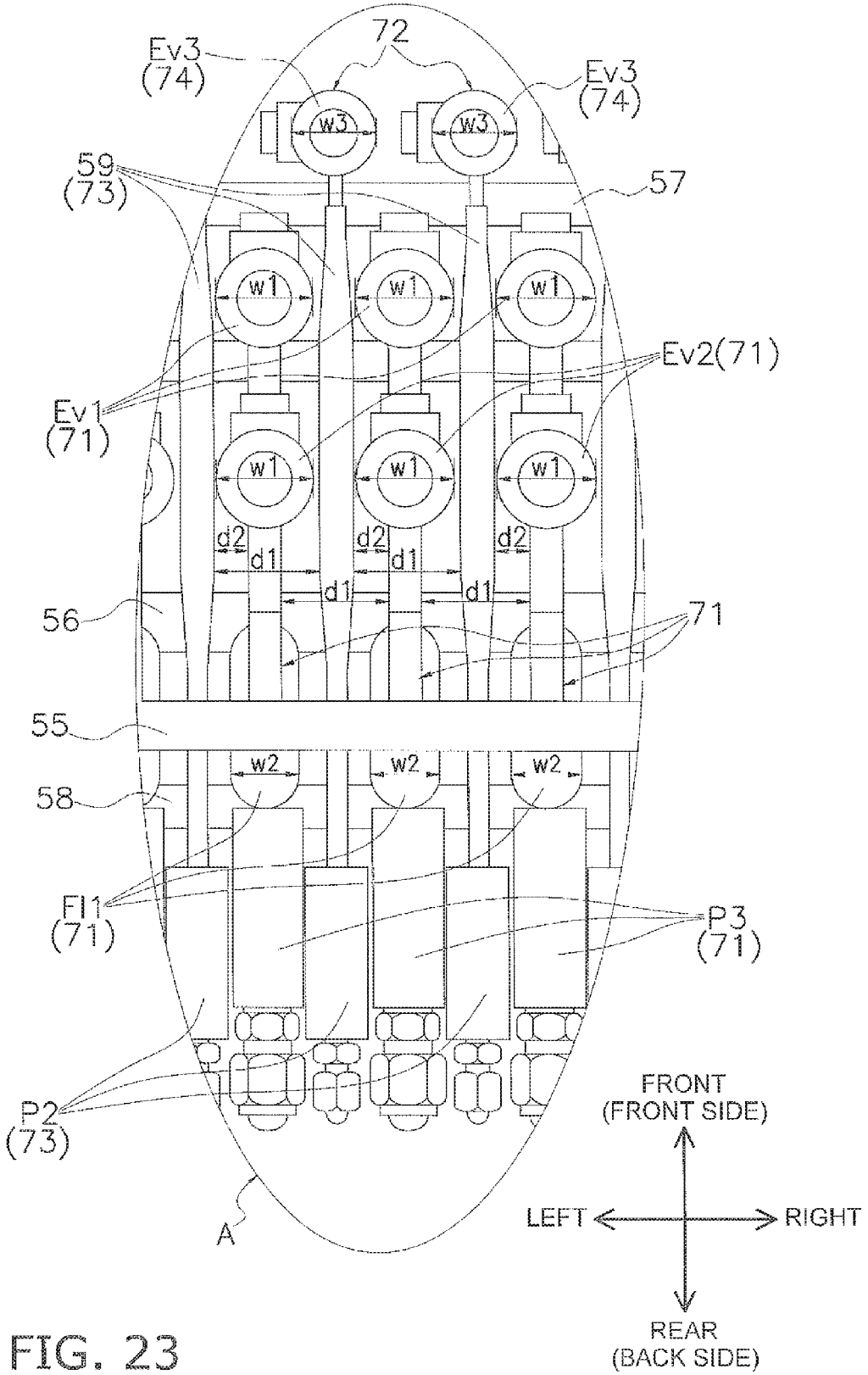
FIG. 23 is an enlarged view of the first and second units illustrated in a region A of FIG. 7.

A method of assembly the BS unit assembly 60 will be hereinafter described in detail. FIG. 14 is a perspective view of a first assembly 80. FIG. 15 is a perspective view of a second assembly 90. FIG. 16 is an exploded view of the BS unit assembly 60. FIGS. 17 to 21 are schematic diagrams showing a procedure of assembling the BS unit assembly 60. FIG. 22 is a bottom view of the first and second assemblies 80 and 90 in an integrated condition. FIG. 23 is an enlarged view of the first unit 71 and the second unit 72 shown in a region A of FIG. 7.

The BS unit assembly 60 is mainly assembled through three steps composed of a first step, a second step and a third step.

(5-1) First Step

The first step is a step for fabricating the first assembly 80 that the plural first units 71 are connected to the second header 56.

In the first step, the plural first units 71 are firstly manufactured. To manufacture each first unit 71, the respective refrigerant pipes, the first and second electric valves Ev1 and Ev2, and the first filter Fl1 are joined by brazing, welding, flare fitting or the like (hereinafter referred to as brazing or the like).

Next, the first assembly 80 is manufactured by joining the plural manufactured first units 71 to the second header 56 by brazing or the like. It should be noted that in the present embodiment, the first assembly 80, as shown in FIG. 14, includes 16 sets of the first units 71 (71*a* to 71*p*).

Specifically, the first units 71 are joined to the second header 56 in the aspect shown in FIG. 14. In other words, each first unit 71 is joined to the second header 56 such that its constituent elements are aligned from the back side to the front side in the sequential order of the third pipe P3, the first filter Fl1, the seventh pipe P7, the fifth pipe P5, the fourth pipe P4, the second electric valve Ev2, the sixth pipe P6 and the first electric valve Ev1. Additionally, each first unit 71 is joined to the second header 56 such that its constituent elements are aligned from up to down in the sequential order of the second electric valve Ev2, the seventh pipe P7, the sixth pipe P6, the first electric valve Ev1, the third pipe P3, the first filter Fl1, the fourth pipe P4 and the fifth pipe P5.

In thus fabricated first assembly 80, as shown in FIG. 14, the first units 71 (71*a* to 71*p*) are respectively aligned in an organized manner at intervals in the right-and-left direction (horizontal direction). A first distance d1 (corresponding to "predetermined interval" described in claims) is reliably produced between adjacent first units 71 as a predetermined clearance (see FIG. 23).

Figure 7:
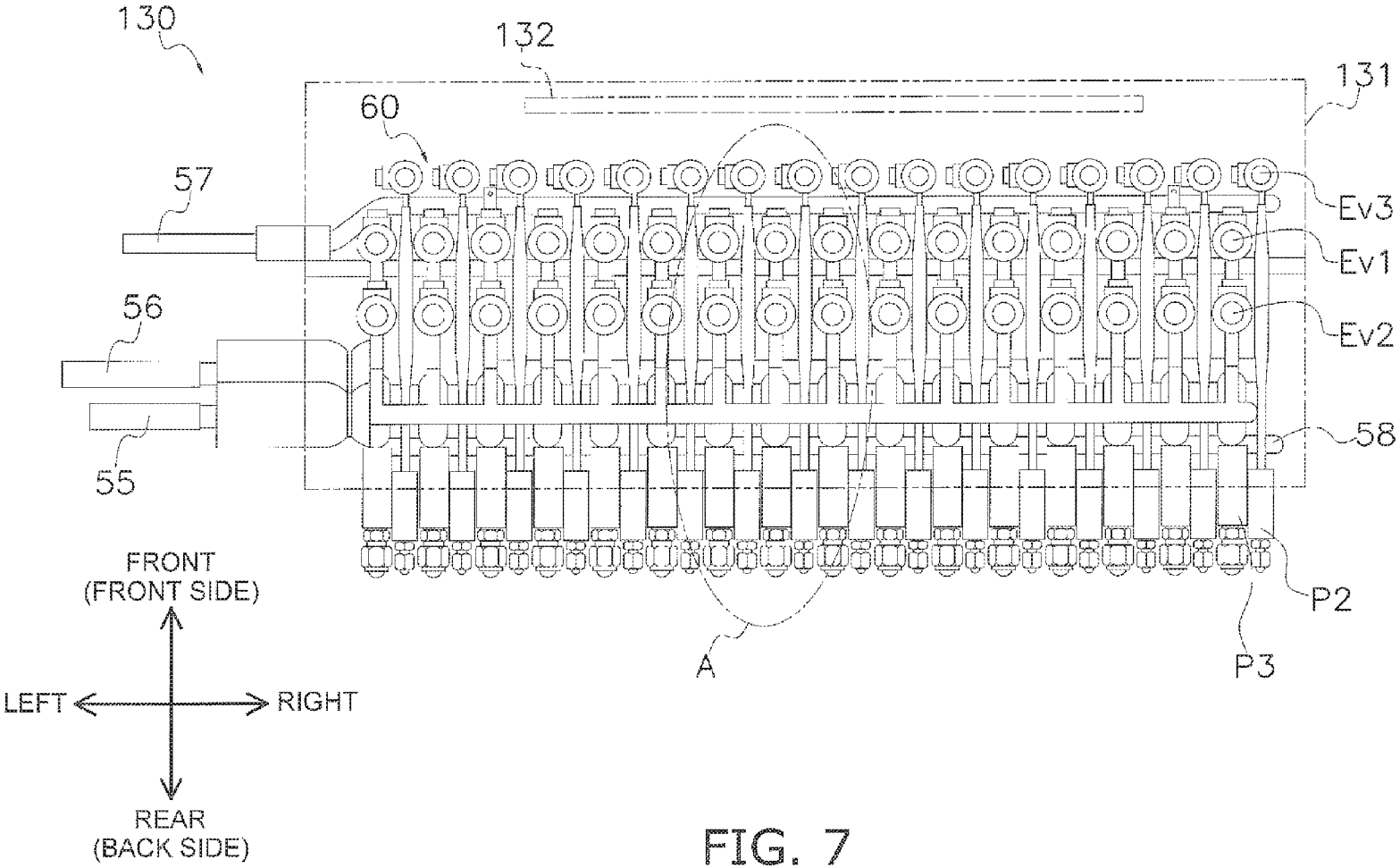
FIG. 7 is a top view of the intermediate unit.
Figure 8:
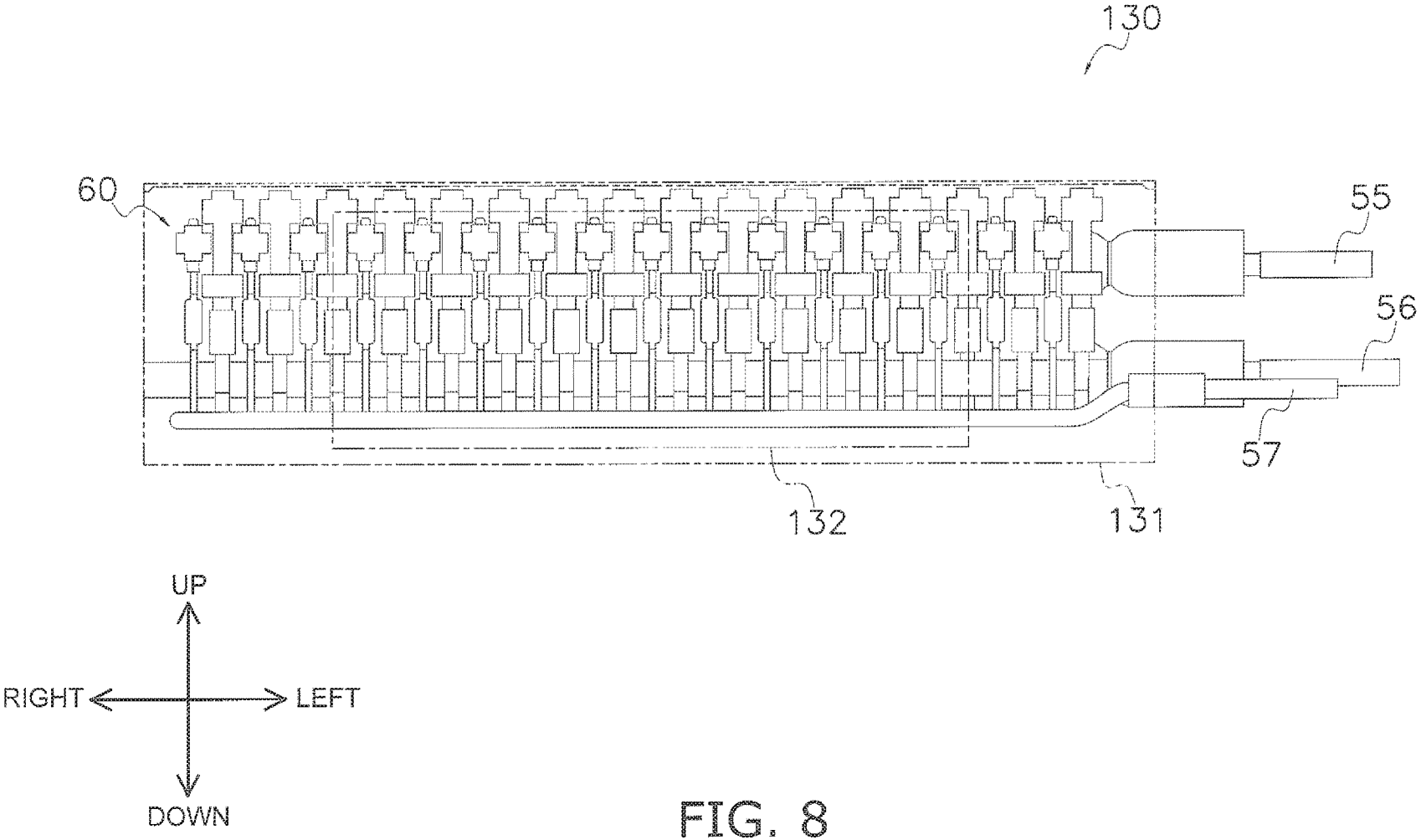
FIG. 8 is a front view of the intermediate unit.

Additionally, as shown in FIGS. 7 and 23, the first units 71 respectively extend roughly in parallel to each other in the back-and-forth direction in the plan view. In other words, each first unit 71 tilts with respect to a straight line extending in parallel to its adjacent first unit 71 at an angle of less than 10 degrees in the plan view.

(5-2) Second Step

The second step is a step for fabricating the second assembly 90 that the plural second units 72 (i.e., the plural liquid communicating units 73 and the plural bypass units 74) are connected to the third header 57 and the fourth header 58.

In the second step, the plural second units 72 are firstly manufactured. To manufacture each second unit 72, the respective refrigerant pipes, the supercooling heat exchange portion 59, the third electric valve Ev3 and the second filter Fl2 are joined by brazing or the like.

Next, the second assembly 90 is manufactured by joining the plural manufactured second units 72 (i.e., the liquid communicating units 73 and the bypass units 74) to the third header 57 and the fourth header 58 by brazing or the like. It should be noted that in the present embodiment, as shown in FIG. 15, the second assembly 90 includes 16 sets of the second units 72 (72*a* to 72*p*).

Specifically, the second units 72 are joined to the third header 57 and the fourth header 58 in the aspect shown in FIG. 15. In other words, each second unit 72 is joined to the third header 57 and the fourth header 58 such that its constituent elements are aligned from the back side to the front side in the sequential order of the second pipe P2, the eighth pipe P8, the supercooling heat exchange portion 59, both of the ninth pipe P9 and the first pipe P1, the eleventh pipe P11, both of the second filter Fl2 and the third electric valve Ev3, and the tenth pipe P10. Additionally, the second unit 72 is joined to the third header 57 and the fourth header 58 such that its constituent elements are aligned from up to down in the sequential order of the second pipe P2, the third electric valve Ev3, the ninth pipe P9, the tenth pipe P10, the second filter Fl2, the supercooling heat exchange portion 59, the eighth pipe P8, the first pipe P1 and the eleventh pipe P11.

In thus fabricated second assembly 90, as shown in FIG. 15, the second units 72 (72*a* to 72*p*) are aligned in an organized manner at intervals in the right-and-left direction (horizontal direction). The first distance d1 (corresponding to "predetermined interval" described in claims) is reliably produced between adjacent second units 72 as a predetermined clearance (see FIG. 23).

It should be noted that the first distances di are approximately constant, and "the first distances d1 are approximately constant" herein encompasses not only a situation that the first distances d1 are exactly the same but also a situation that the first distances d1 are slightly different from each other. For example, the first distances d1 are interpreted as approximately constant when, in every pair of the first distances d1, one first distance d1 is different from the other first distance d1 by one-third of the other first distance d1 or less.

Additionally, as shown in FIGS. 7 and 23, the second units 72 respectively extend roughly in parallel to each other in the back-and-forth direction in the plan view in other words, each second unit 72 tilts with respect to a straight line extending in parallel to its adjacent second unit 72 at an angle of less than 10 degrees in the plan view.

(5-3) Third Step

The third step is a step for manufacturing the BS unit assembly 60 by combining and integrating the first assembly 80 manufactured in the first step and the second assembly 90 manufactured in the second step.

In the third step, the first assembly 80 and the second assembly 90 are conceptually fixed in the aspect shown in FIG. 16. In other words, the BS unit assembly 60 is assembled by incorporating the second assembly 90 into the first assembly 80 and then joining the first connecting parts 561 and the second connecting parts 581 to each other. Specifically, the second assembly 90 is incorporated into the first assembly 80 in a method shown in FIGS. 17 to 21.

Figure 17:
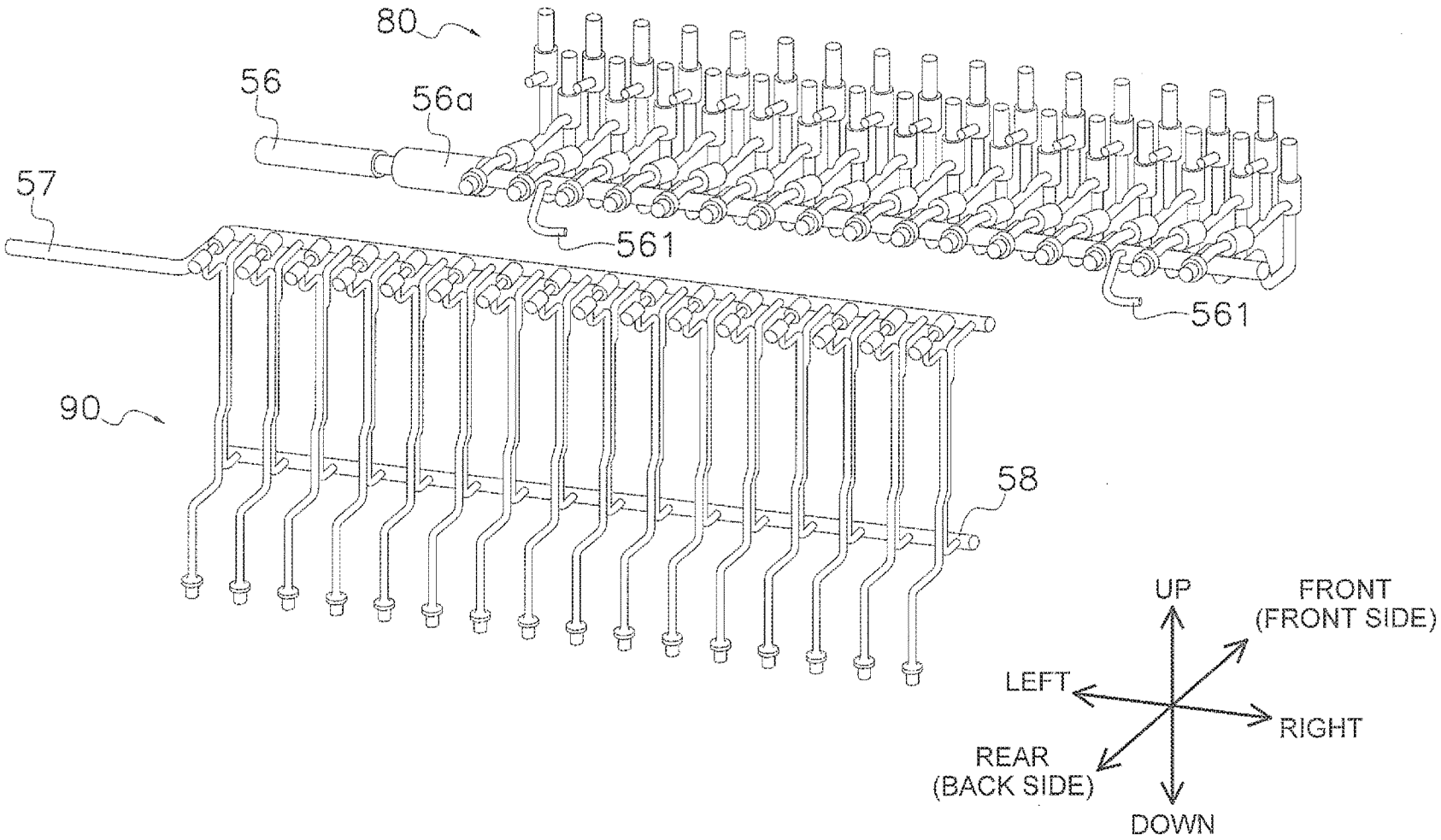
FIG. 17 is a schematic diagram showing a procedure of assembling the BS unit assembly.

First, the first assembly 80 is fixed by a jig or the like. Then, as shown in FIG. 17, the second assembly 90 is tilted up to the back side such that the third header 57 is located in the top position.

Figure 18:
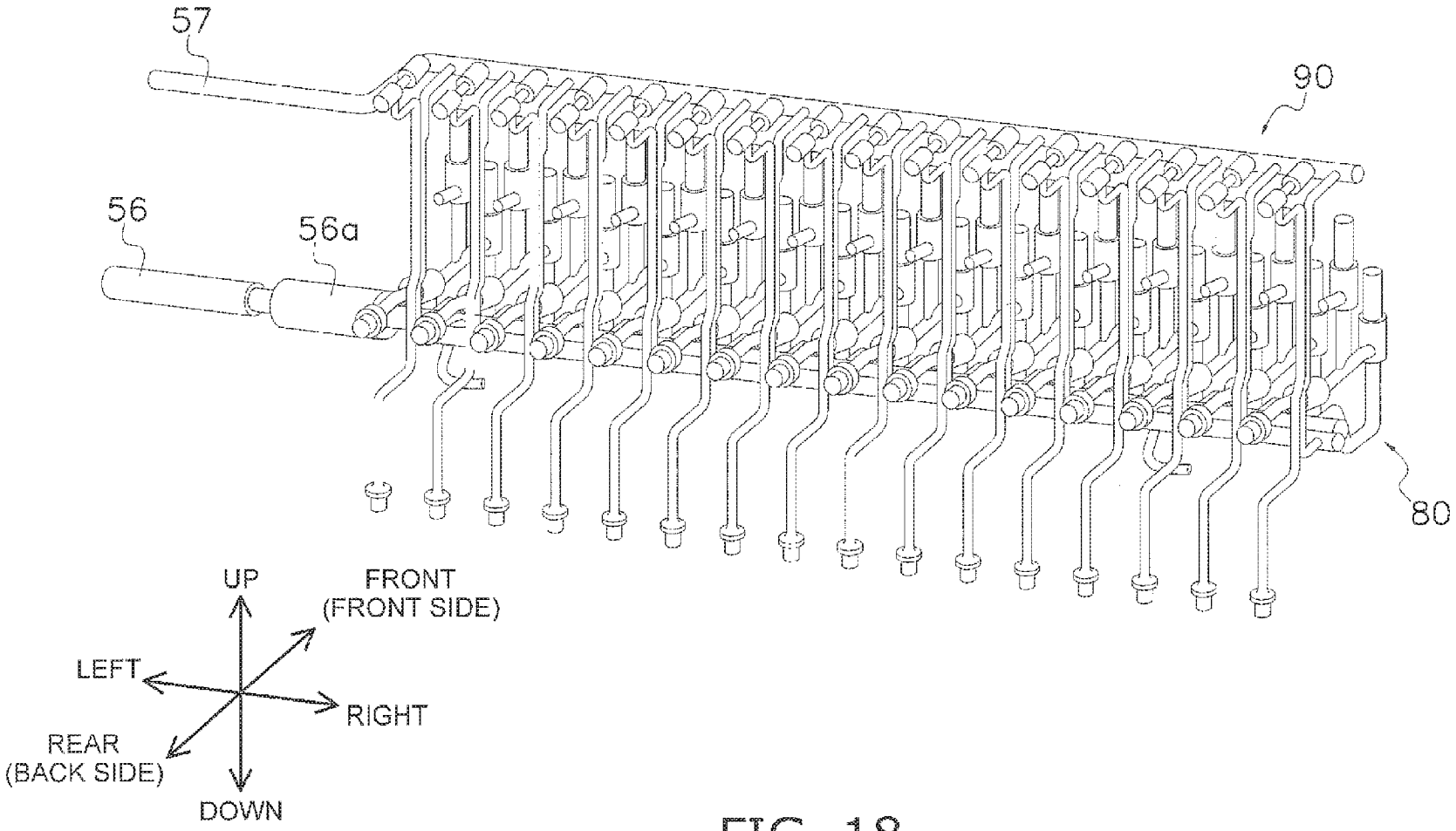
FIG. 18 is a schematic diagram showing the procedure of assembling the BS unit assembly.

Next, as shown in FIG. 18, the second assembly 90 is approached to the first assembly 80 while being tilted up.

Figure 19:
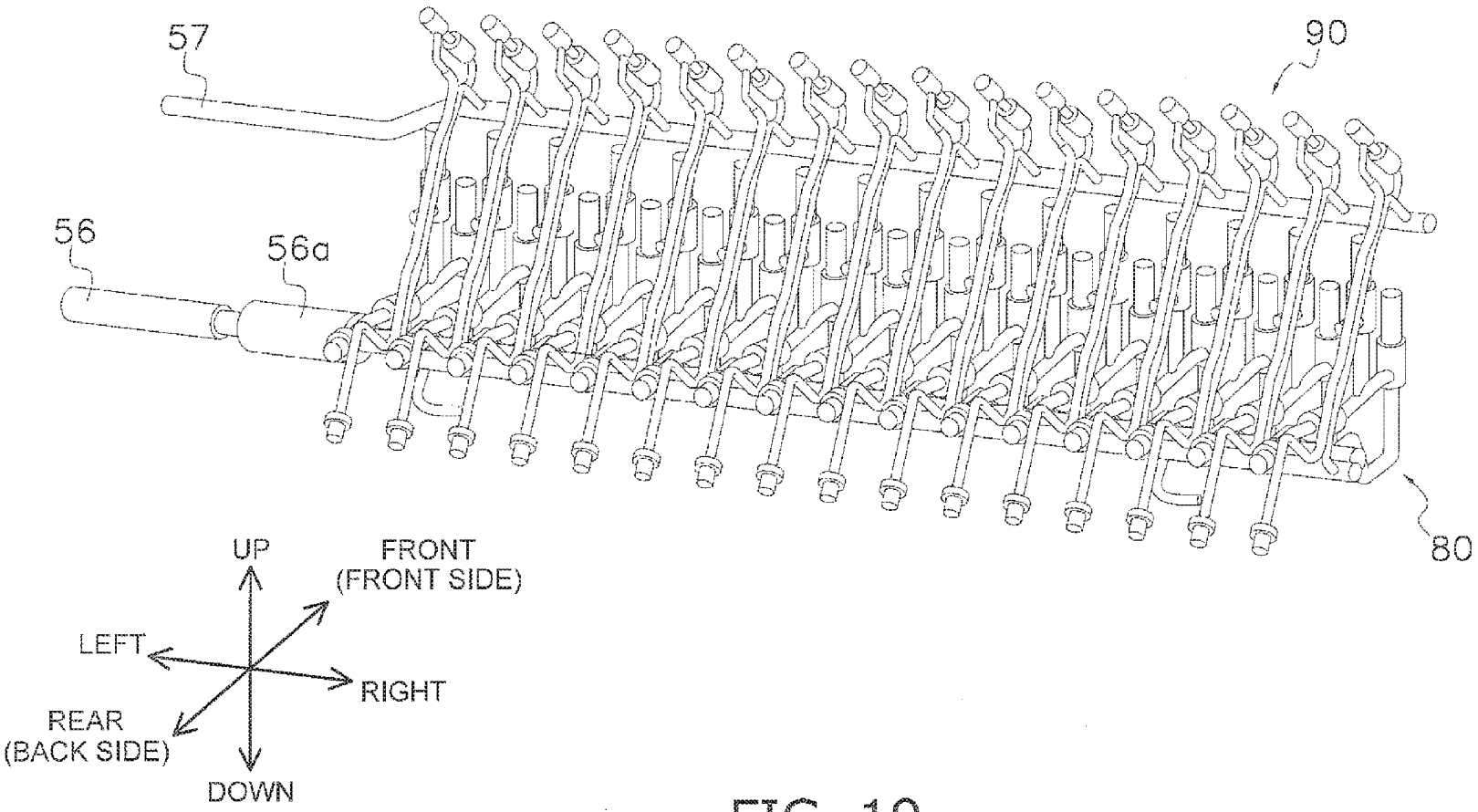
FIG. 19 is a schematic diagram showing the procedure of assembling the BS unit assembly.
Figure 20:
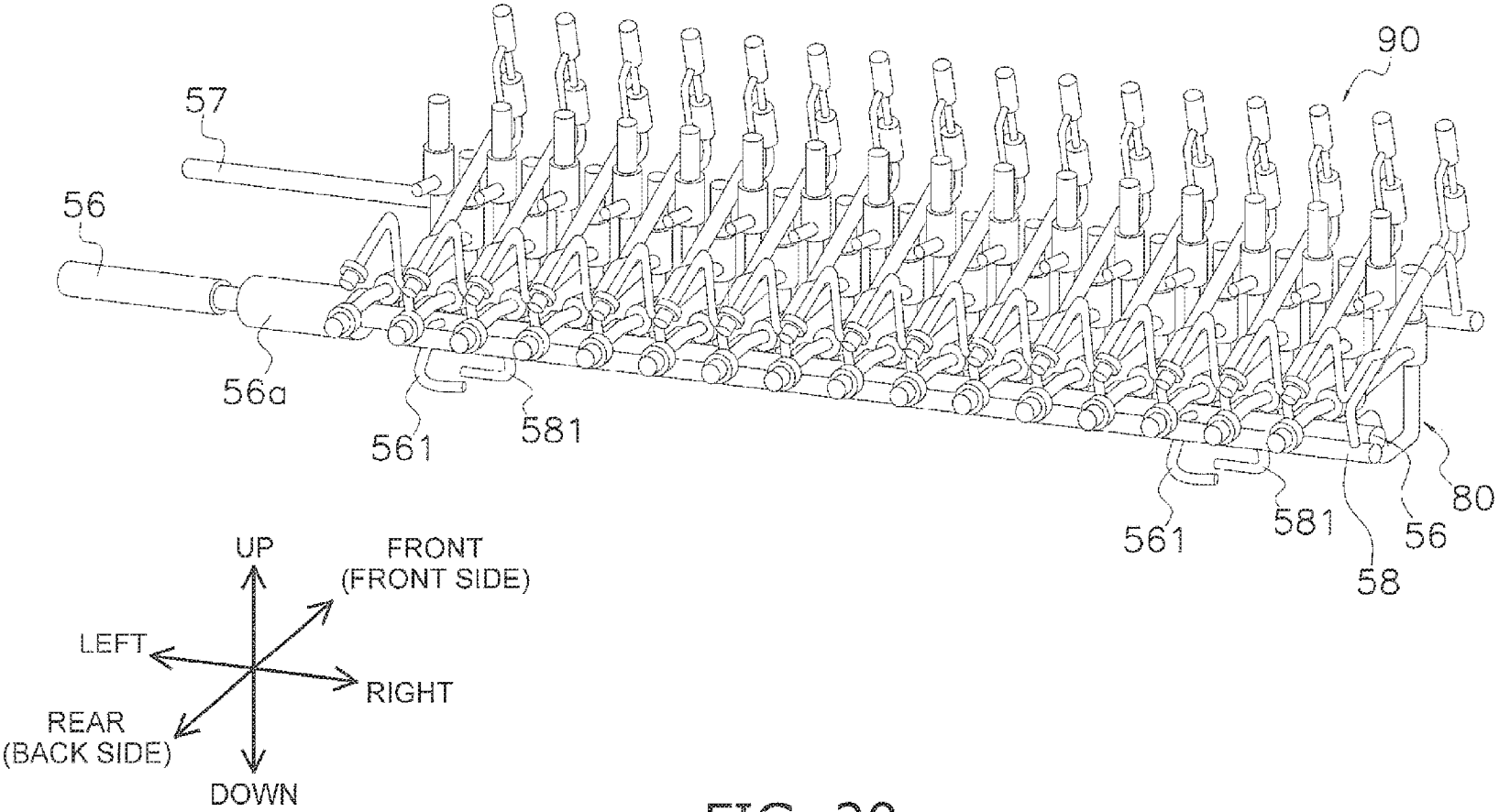
FIG. 20 is a schematic diagram showing the procedure of assembling the BS unit assembly.

Subsequently, as shown in FIGS. 19 and 20, the second assembly 90 is tilted down to the front side until the third header 57 is located in the bottom position. At this time, the second assembly 90 is gradually tilted down such that the first unit 71*a*. which is the rightmost one of the first units 71 in the first assembly 80, is interposed between the second unit 72*a*. which is the rightmost one of the second units 72 in the second assembly 90, and the second unit 72*b* located on the left side of the second unit 72*a*.

Figure 21:
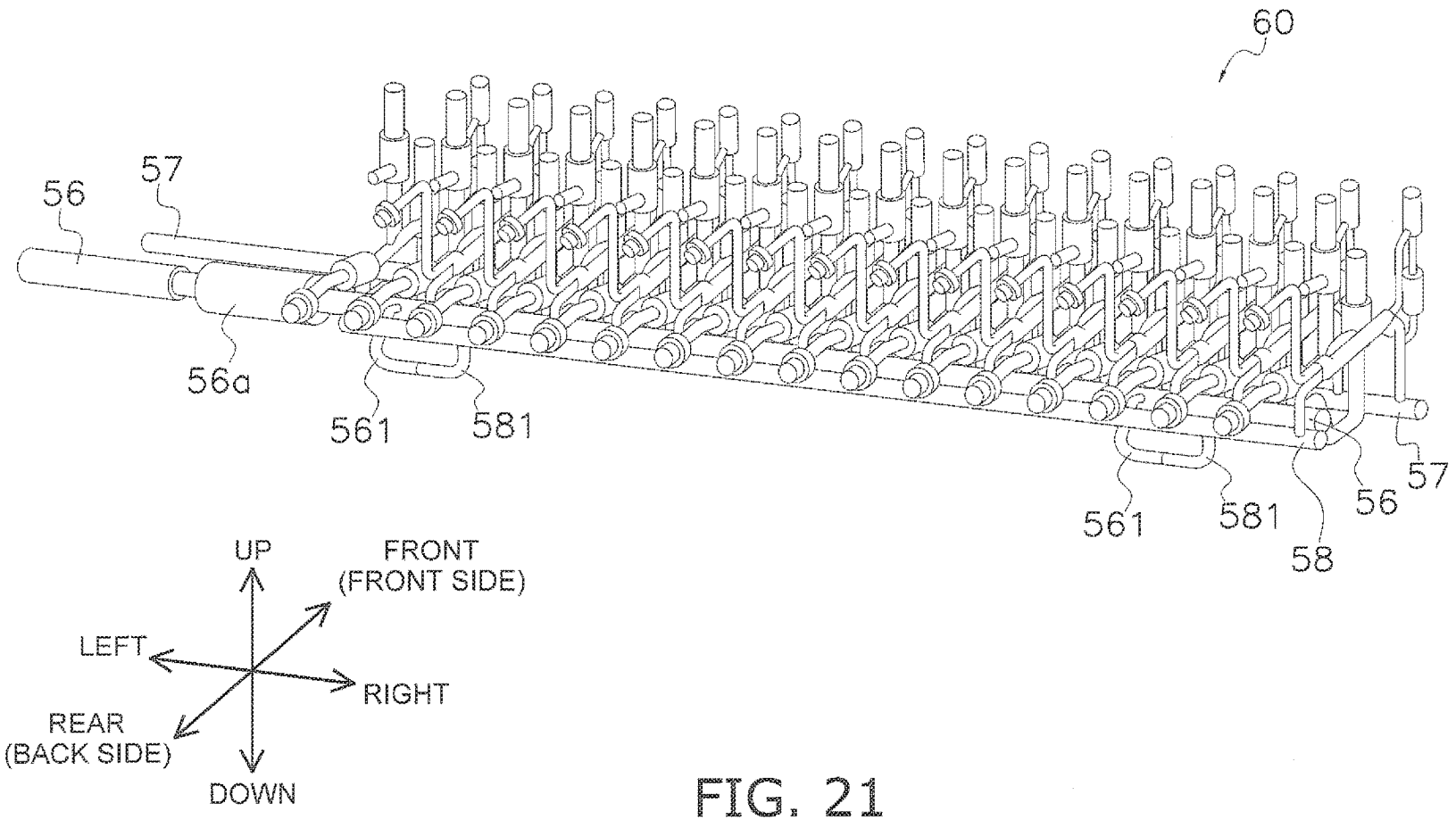
FIG. 21 is a schematic diagram showing the procedure of assembling the BS unit assembly.

By gradually tilting down the second assembly 90 in this aspect, the third header 57 is located in a lower position than the second header 56 in due course as shown in FIG. 21. Then, under the condition, the first connecting parts 561 and the second connecting parts 581 are joined to each other.

Finally, the third header 57 and the second header 56 are fixed with a fixing tool 601, and then, the first header 55 is joined to the seventh pipes P7 of the respective first units 71.

In thus assembled BS unit assembly 60, the first units 71 and the second units 72 are alternately aligned at clearances in an organized manner in the horizontal direction (see FIG. 10, FIG. 23, etc.) such that each first unit 71 extends in approximately parallel to its adjacent first unit 71 at the first distance d1 whereas each second unit 72 extends in approximately parallel to its adjacent second unit 72 at the first distance d1.

More specifically, in this condition, a second distance d2, which is a clearance between an adjacent pair of the first unit 71 and the second unit 72, is set to be smaller than a width w2 of the first filter Fl1. It should be noted that the second distances d2 are approximately constant. "The second distances d2 are approximately constant" herein encompasses not only a situation that the second distances d2 are exactly the same but also a situation that the second distances d2 are slightly different from each other. For example, the second distances d2 are interpreted as approximately constant when, in every pair of the second distances d2, one second distance d2 is different from the other second distance d2 by one-third of the other second distance d2 or less.

Additionally, the supercooling heat exchange portion 59 included in each second unit 72 (each liquid communicating unit 73) extends in the back-and-forth direction. In other words, the supercooling heat exchange portion 59 extends approximately in parallel to each first unit 71 that also extends in the back-and-forth direction. In short, the supercooling heat exchange portion 59 tilts with respect to a straight line extending in parallel to its adjacent first unit 71 at an angle of less than 10 degrees in a plan view.

Additionally in FIG. 23, regarding each pair of the first and second electric valves Ev1 and Ev2, the both valves Ev1 and Ev2 are straightly aligned in the back-and-forth direction that each first unit 71 extends. More specifically, regarding each pair of the first and second electric valves Ev1 and Ev2, the first electric valve Ev1 is located on the front side whereas the second electric valve Ev2 is located on the back side. Additionally, each of the first and second electric valves Ev1 and Ev2 overlaps with the first unit 71 in the plan view. In other words, each pair of the first and second electric valves Ev1 and Ev2 is disposed on a straight line on which each first unit 71 extends in the plan view.

Additionally, as shown in FIG. 22, FIG. 23 and the like, each first unit 71 is connected approximately perpendicularly to the first header 55 and the second header 56, whereas each second unit 72 is connected approximately perpendicularly to the third header 57 and the fourth header 58. In other words, the seventh pipe P7 of each first unit 71 connected to the first header 55 tilts with respect to a line perpendicular to the first header 55 at an angle of less than 10 degrees. Likewise, the fifth pipe P5 of each first unit 71 connected to the second header 56 tilts with respect to a line perpendicular to the second header 56 at an angle of less than 10 degrees. Likewise, the first pipe P1 of each second unit 72 (each liquid communicating unit 73) connected to the third header 57 tilts with respect to a line perpendicular to the third header 57 at an angle of less than 10 degrees. Likewise, the eighth pipe P8 of each second unit 72 (each bypass unit 74) connected to the fourth header 58 tilts with respect to a line perpendicular to the fourth header 58 at an angle of less than 10 degrees.

Moreover, as shown in FIG. 22, the first header 55, the second header 56, the third header 57 and the fourth header 58 extend approximately in parallel to each other in the right-and-left direction. In other words, each header tilts with respect to a straight line extending in parallel to each of the other headers at an angle of less than 10 degrees.

Furthermore, in FIG. 22, the first connecting parts 561 extend in the back-and-forth direction. In other words, each first connecting part 561 extends in a direction intersecting with the extending direction (right-and-left direction) of the fourth header 58. On the other hand, each second connecting part 581 extends in the right-and-left direction. In other words, each second connecting part 581 extends approximately in parallel to the extending direction (right-and-left direction) of the fourth header 58.

(6) Features (6-1)

In the aforementioned embodiment, the BS unit assembly 60 of the intermediate unit 130 includes: the plural first units 71 connected to the high-low pressure gas communicating pipe 13 and the suction gas communicating pipe 12; and the second units 72, each of which includes the liquid communicating unit 73 that is configured and arranged to be connected at one end to the liquid communicating pipe 11 and to be connected at the other end to its relevant liquid pipe LP. Additionally, in the BS unit assembly 60 of the intermediate unit 130, every adjacent two of the first units 71 extend approximately in parallel to each other at the first distance d1; every adjacent two of the second units 72 (the liquid communicating units 73) extend approximately in parallel to each other at the first distance d1; and the first units 71 and the second units 72 (the liquid communicating units 73) are alternately disposed. With the construction, the plural first units 71 and the plural second units 72 (the liquid communicating units 73) are aligned in an organized manner at predetermined clearances. As a result, the plural first units 71 and the plural second units 72 (the liquid communicating units 73) are compactly aggregated. Therefore, the intermediate unit 130 is compactly constructed.

(6-2)

In the aforementioned embodiment, the first units 71 and the second units 72 (the liquid communicating units 73) are alternately disposed in horizontal alignment. With the alignment, the BS unit assembly 60 has a structure elongated in the right-and-left direction (horizontal direction). Thus, the up-and-down directional (vertical) length of the BS unit assembly 60 is inhibited from increasing with increase in number of the first units 71 and that of the second units 72. As a result, the intermediate unit 130 is constructed with compact vertical length. Therefore, it becomes easy to install the intermediate unit 130 even in a small and narrow space with short vertical length (e.g., space above the ceiling).

(6-3)

In the aforementioned embodiment, each first unit 71 includes the first filter Fl1 for removing impurities, and the second distance d2, which is an interval between every adjacent pair of the first unit 71 and the second unit 72 (the liquid communicating unit 73), is set to be smaller than the width w2 of the first filter Fl1. As a result, the plural first units 71 and the plural second units 72 (the liquid communicating units 73) are compactly aggregated.

(6-4)

In the aforementioned embodiment, the first electric valve Ev1 and the second electric valve Ev2, mounted to each first unit 71, are disposed on the straight line on which each first unit 71 extends in a plan view With the construction, the first distance d1 can be more reduced than when the respective electric valves are displaced from the straight line on which each first unit 71 extends in a plan view As a result, the second distance d2 can be reduced, and the plural first units 71 and the plural second units 72 (the liquid communicating units 73) are compactly aggregated.

(6-5)

In the aforementioned embodiment, the supercooling heat exchange portion 59, mounted to each second unit 72 (each liquid communicating unit 73), extends approximately in parallel to the first unit 71, and has a structure that heat exchange is performed between the refrigerant passing inside the liquid communicating unit 73 and the refrigerant passing through the bypass unit 74 provided with the third electric valve Ev3. Thus, with the construction that each second unit 72 (each liquid communicating unit 73) is provided with the supercooling heat exchange portion 59, in a situation that the indoor unit 120*a* performs a heating operation whereas the indoor unit 120*b* performs a cooling operation, for instance, it becomes possible in the BS unit 70 relevant to the indoor unit 120*a* to supercool the refrigerant condensed/radiated in the indoor unit 120*a*. and degradation in cooling performance of the indoor unit 120*b* is inhibited. Additionally, with the construction that the supercooling heat exchange portion 59 extends approximately in parallel to its relevant first unit 71, the plural first units 71 and the plural second units 72 (the liquid communicating units 73 are compactly aggregated.

(6-6)

In the aforementioned embodiment, the first units 71 are connected to the high-low pressure gas communicating pipe 13 through the first header 55, and are also connected to the suction gas communicating pipe 12 through the second header 56. Additionally, the second units 72 (the liquid communicating units 73) are connected to the liquid communicating pipe 11 through the third header 57. Moreover, the first units 71 are connected approximately perpendicularly to the first header 55 and the second header 56, whereas the second units 72 (the liquid communicating units 73) are connected approximately perpendicularly to the third header 57. Thus, with the construction that the first units 71 or the second units 72 (the liquid communicating units 73) are connected to the high-low pressure gas communicating pipe 13, the suction gas communicating pipe 12 or the liquid communicating pipe 11 through the headers, the first units 71 and the second units 72 (the liquid communicating units 73) can be easily connected to the high-low pressure gas communicating pipe 13, the suction gas communicating pipe 12 or the liquid communicating pipe 11. Additionally, with the construction that the first units 71 and the second units 72 (the liquid communicating units 73) are connected approximately perpendicularly to the headers, the plural first units 71 and the plural second units 72 (the liquid communicating units 73) are compactly aggregated in organized alignment.

(6-7)

In the aforementioned embodiment, the fourth header 58 is provided, and pipes are inhibited from being connected in a complex aspect even in the construct of bypassing the refrigerant inside the second header 56 to the liquid communicating unit 73. Additionally, the fourth header 58 extends approximately in parallel to the first header 55, the second header 56 and the third header 57. The first connecting parts 561 extend in the direction intersecting with the extending direction of the fourth header 58, whereas the second connecting parts 581 extend approximately in parallel to the extending direction of the fourth header 58 and are connected to the first connecting parts 561. The eighth pipe P8 of each bypass unit 74 is connected approximately perpendicularly to the fourth header 58. Accordingly, the plural first units 71 and the plural second units 72 (the liquid communicating units 73) are compactly aggregated in organized alignment.

(6-8)

In the aforementioned embodiment, the process of manufacturing the BS unit assembly 60 in the intermediate unit 130 includes: the first step of fabricating the first assembly 80 by connecting the plural first units 71 and the second header 56; the second step of fabricating the second assembly 90 by connecting the plural second units 72 (the liquid communicating units 73) and both of the third header 57 and the fourth header 58; and the third step of fabricating the BS unit assembly 60 by combining the first assembly 80 and the second assembly 90. Accordingly, it is possible to easily and efficiently manufacture the intermediate unit 130, which is good in compactness, with a small number of steps.

(7) Modifications (7-1) Modification A

In the aforementioned embodiment, the air conditioning system 100 is designed to include a single set of the outdoor unit 110. However, the number of sets of the outdoor units 110 is not limited to the above, and may be plural. Additionally, the air conditioning system 100 is designed to include 16 sets of the indoor units 120. However, the number of sets of the indoor units 120 is not limited to the above, and may be any arbitrary number.

(7-2) Modification B

In the aforementioned embodiment, the intermediate unit 130 (the BS unit assembly 60) is designed to include 16 sets of the BS units 70. However, the number of sets of the BS units 70 is not limited to the above, and may be any arbitrary number. For example, the number of sets of the BS units 70 disposed in the intermediate unit 130 (the BS unit assembly 60) may be four, six or eight, and alternatively, may be twenty-four.

(7-3) Modification C

In the aforementioned embodiment, in the intermediate unit 130 (the BS unit assembly 60), the first units 71 and the second units 72 (the liquid communicating units 73) are alternately aligned in the horizontal direction. However, alignment of the first units 71 and the second units 72 is not limited to the above. For example, the first units 71 and the second units 72 (the liquid communicating units 73) may be alternately disposed in vertical alignment.

(7-4) Modification D

In the aforementioned embodiment, each second unit 72 is designed to include the liquid communicating unit 73 and the bypass unit 74. Alternatively, for instance, the second unit 72 may not be provided with the bypass unit 74, and may be composed of only the liquid communicating unit 73. In this case, the liquid communicating unit 73 is not provided with the supercooling heat exchange portion 59, and the second pipe P2 and the first pipe P1 are connected in the liquid communicating unit 73.

(7-5) Modification E

In the aforementioned embodiment, the eighth pipe P8 of the bypass unit 74 is designed to be connected to the fourth header 58. However, the constituent element to which the eighth pipe P8 is connected is not limited to the above. Alternatively, the eighth pipe P8 may be connected to the second header 56. In this case, the fourth header 58 is not provided, and the bypass unit 74 is designed to bypass the refrigerant within the second header 56 directly to the liquid communicating unit 73.

(7-6) Modification F

In the aforementioned embodiment, electric valves are employed as the first electric valve the second electric valve Ev2 and the third electric valve Ev3. However, the first electric valve Ev1, the second electric valve Ev2 or the third electric valve Ev3 is not necessarily an electric valve, and may be alternatively, for instance, an electro-magnetic valve.

(7-7) Modification G

In the aforementioned embodiment, the electric valve employed as the second electric valve Ev2 is of a type that the minute channel is formed in its interior and that is configured not to be fully closed even at the minimum opening degree. However, the electric valve employed as the second electric valve Ev2 is not limited to be of this type. Alternatively, the electric valve employed as the second electric valve Ev2 may be of a type that any minute channel is not formed in its interior, and a bypass pipe such as a capillary tube may be connected to the second electric valve Ev2.

(7-8) Modification H

In the aforementioned embodiment, the first assembly 80 is manufactured by joining the plural first units 71 to the second header 56 in the first step. However, the method of manufacturing the first assembly 80 is not limited to the above. Alternatively, the first assembly 80 may be manufactured by joining the plural first units 71 to the first header 55. In this case, the second header 56 will be joined to the first units 71 in the third step.

Additionally, the second assembly 90 is manufactured by joining the plural second units 72 (the liquid communicating units 73) to the third header 57 and the fourth header 58 in the second step. The method of manufacturing the second assembly 90 is not limited to the above. Alternatively, the second assembly 90 may be manufactured by joining the plural second units 72 (the liquid communicating units 73) to either of the third header 57 and the fourth header 58. In this case, the plural second units 72 (the liquid communicating units 73) will be joined to the other of the third header 57 and the fourth header 58 in the third step.

Moreover, the BS unit assembly 60 is manufactured by combining the second assembly 90 with the fixed first assembly 80 in the third step. However, the method of manufacturing the BS unit assembly 60 is not limited to the above. Alternatively, the BS unit assembly 60 may be manufactured by combining the first assembly 80 with the fixed second assembly 90.

INDUSTRIAL APPLICABILITY

The present invention can be utilized for an aggregated channel switching unit and a method of manufacturing the aggregated channel switching unit.

What is claimed is:

1. An aggregated channel switching unit adapted to be disposed between a heat source unit and a plurality of utilization units, the aggregated channel switching unit being configured and arranged to switch flow of refrigerant in a refrigerant circuit formed by the heat source unit and the plurality of utilization units, the aggregated channel switching unit comprising:

a plurality of first refrigerant pipes, each of the first refrigerant pipes being provided with a switch valve, the first refrigerant pipes being configured and arranged to be connected to a high-low pressure gas communicating pipe and a suction gas communicating pipe, and the high-low pressure gas communicating pipe and the suction gas communicating pipe extending from the heat source unit;

a plurality of second refrigerant pipes, each of the second refrigerant pipes being configured and arranged to be connected at one end to a liquid communicating pipe extending from the heat source unit, and each of the second refrigerant pipes being configured and arranged to be connected at the other end to a liquid pipe extending to the utilization units; and a casing configured and arranged to accommodate the plurality of first refrigerant pipes and the plurality of second refrigerant pipes, with the plurality of first refrigerant pipes and the plurality of second refrigerant pipes being aggregated as an assembly, every adjacent two of the plurality of first refrigerant pipes being configured and arranged to extend approximately in parallel to each other at a predetermined interval in the assembly, every adjacent two of the plurality of second refrigerant pipes being configured and arranged to extend approximately in parallel to each other at a predetermined interval in the assembly, and the first refrigerant pipes and the second refrigerant pipes are alternately disposed in the assembly.

2. The aggregated channel switching unit according to claim 1, wherein the first refrigerant pipes and the second refrigerant pipes are configured and arranged to be alternately disposed in horizontal alignment.

3. The aggregated channel switching unit according to claim 1, wherein each of the first refrigerant pipes includes a refrigerant pipe filter configured and arranged to remove impurities, and an interval between every adjacent pair of the first refrigerant pipe and the second refrigerant pipe is smaller than a width of the refrigerant pipe filter.

4. The aggregated channel switching unit according to claim 1, wherein each switch valve includes a first switch valve and a second switch valve, and the first switch valve and the second switch valve are configured and arranged to be disposed on a straight line on which the first refrigerant pipe extends in a plan view.

5. The aggregated channel switching unit according to claim 1, wherein each of the second refrigerant pipes is provided with a supercooling heat exchange portion between the one end and the other end, the supercooling heat exchange portion being configured and arranged to cool the refrigerant passing inside the second refrigerant pipe, each of the supercooling heat exchange portions is configured and arranged to have a structure such that heat exchange is performed between the refrigerant passing inside the second refrigerant pipe and the refrigerant passing inside another refrigerant pipe provided with a third switch valve configured and arranged to regulate flow rate of the refrigerant passing inside the another refrigerant pipe, and the supercooling heat exchange portions are configured and arranged to extend approximately in parallel to the first refrigerant pipes.

6. The aggregated channel switching unit according to claim 1, further comprising:

a first header, a second header and a third header, the first, second and third headers being configured and arranged to extend approximately in parallel to each other, the first refrigerant pipes are configured and arranged to be connected approximately perpendicularly to the first header and the second header, the first refrigerant pipes are configured and arranged to be connected to the high-low pressure gas communicating pipe through the first header, and the first refrigerant pipes are configured and arranged to be connected to the suction gas communicating pipe through the second header, and the second refrigerant pipes are configured and arranged to be connected approximately perpendicularly to the third header, and the second refrigerant pipes are configured and arranged to be connected to the liquid communicating pipe through the third header.

7. The aggregated channel switching unit according to claim 6, further comprising:

a fourth header configured and arranged to extend approximately in parallel to the first, second and third headers;

a connecting pipe configured and arranged to connect the second header and the fourth header and being configured and arranged to feed the refrigerant inside the second header to the fourth header; and a bypass pipe configured and arranged to bypass the refrigerant inside the fourth header to the second refrigerant pipes, the bypass pipe being configured and arranged to be connected approximately perpendicularly to the fourth header, the connecting pipe including a first part and a second part, the first part being configured and arranged to extend in a direction intersecting with an extending direction of the fourth header, and the second part being configured and arranged to extend approximately in parallel to the extending direction of the fourth header and being configured and arranged to be connected to the first part, and the first part extending approximately in parallel to the extending direction of the fourth header in a connected part thereof to the second part.

8. A method of manufacturing the aggregated channel switching unit according to claim 7, the method comprising:

a first step of fabricating a first assembly by connecting the first header or the second header and the plurality of first refrigerant pipes;

a second step of fabricating a second assembly by connecting the third header or the fourth header and the plurality of second refrigerant pipes; and a third step of combining the first assembly and the second assembly.

9. The aggregated channel switching unit according to claim 2, wherein each of the first refrigerant pipes includes a refrigerant pipe filter configured and arranged to remove impurities, and an interval between every adjacent pair of the first refrigerant pipe and the second refrigerant pipe is smaller than a width of the refrigerant pipe filter.

10. The aggregated channel switching unit according claim 2, wherein each switch valve includes a first switch valve and a second switch valve, and the first switch valve and the second switch valve are configured and arranged to be disposed on a straight line on which the refrigerant pipe extends in a plan view.

11. The aggregated channel switching unit according to claim 2, wherein each of the second refrigerant pipes is provided with a supercooling heat exchange portion between the one end and the other end, the supercooling heat exchange portion being configured and arranged to cool the refrigerant passing inside the second refrigerant pipe, each of the supercooling heat exchange portions is configured and arranged to have a structure such that heat exchange is performed between the refrigerant passing inside the second refrigerant pipe and the refrigerant passing inside another refrigerant pipe provided with a third switch valve configured and arranged to regulate flow rate of the refrigerant passing inside the another refrigerant pipe, and the supercooling heat exchange portions are configured and arranged to extend approximately in parallel to the first refrigerant pipes.

12. The aggregated channel switching unit according to claim 2, further comprising:

a first header, a second header and a third header, the first, second and third headers being configured and arranged to extend approximately in parallel to each other, the first refrigerant pipes are configured and arranged to be connected approximately perpendicularly to the first header and the second header, the first refrigerant pipes are configured and arranged to be connected to the high-low pressure gas communicating pipe through the first header, and the first refrigerant pipes are configured and arranged to be connected to the suction gas communicating pipe through the second header, and the second refrigerant pipes are configured and arranged to be connected approximately perpendicularly to the third header, and the second refrigerant pipes are configured and arranged to be connected to the liquid communicating pipe through the third header.

13. The aggregated channel switching unit according to claim 3, wherein each switch valve includes a first switch valve and a second switch valve, and the first switch valve and the second switch valve are configured and arranged to be disposed on a straight line on which the first refrigerant pipe extends in a plan view.

14. The aggregated channel switching unit according to claim 3, wherein each of the second refrigerant pipes is provided with a supercooling heat exchange portion between the one end and the other end, the supercooling heat exchange portion being configured and arranged to cool the refrigerant passing inside the second refrigerant pipe, each of the supercooling heat exchange portions is configured and arranged to have a structure such that heat exchange is performed between the refrigerant passing inside the second refrigerant pipe and the refrigerant passing inside another refrigerant pipe provided with a third switch valve configured and arranged to regulate flow rate of the refrigerant passing inside the another refrigerant pipe, and the supercooling heat exchange portions are configured and arranged to extend approximately in parallel to the first refrigerant pipes.

15. The aggregated channel switching unit according to claim 3, further comprising:

a first header, a second header and a third header, the first, second and third headers being configured and arranged to extend approximately in parallel to each other, the first refrigerant pipes are configured and arranged to be connected approximately perpendicularly to the first header and the second header, the first refrigerant pipes are configured and arranged to be connected to the high-low pressure gas communicating pipe through the first header, and the first refrigerant pipes are configured and arranged to be connected to the suction gas communicating pipe through the second header, and the second refrigerant pipes are configured and arranged to be connected approximately perpendicularly to the third header, and the second refrigerant pipes are configured and arranged to be connected to the liquid communicating pipe through the third header.

16. The aggregated channel switching unit according to claim 4, wherein each of the second refrigerant pipes is provided with a supercooling heat exchange portion between the one end and the other end, the supercooling heat exchange portion being configured and arranged to cool the refrigerant passing inside the second refrigerant pipe, each of the supercooling heat exchange portions is configured and arranged to have a structure such that heat exchange is performed between the refrigerant passing inside the second refrigerant pipe and the refrigerant passing inside another refrigerant pipe provided with a third switch valve configured and arranged to regulate flow rate of the refrigerant passing inside the another refrigerant pipe, and the supercooling heat exchange portions are configured and arranged to extend approximately in parallel to the first refrigerant pipes.

17. The aggregated channel switching unit according to claim 4, further comprising:

a first header, a second header and a third header, the first, second and third headers being configured and arranged to extend approximately in parallel to each other, the first refrigerant pipes are configured and arranged to be connected approximately perpendicularly to the first header and the second header, the first refrigerant pipes are configured and arranged to be connected to the high-low pressure gas communicating pipe through the first header, and the first refrigerant pipes are configured and arranged to be connected to the suction gas communicating pipe through the second header, and the second refrigerant pipes are configured and arranged to be connected approximately perpendicularly to the third header, and the second refrigerant pipes are configured and arranged to be connected to the liquid communicating pipe through the third header.

18. The aggregated channel switching unit according to claim 5, further comprising:

a first header, a second header and a third header, the first, second and third headers being configured and arranged to extend approximately in parallel to each other, the first refrigerant pipes are configured and arranged to be connected approximately perpendicularly to the first header and the second header, the first refrigerant pipes are configured and arranged to be connected to the high-low pressure gas communicating pipe through the first header, and the first refrigerant pipes are configured and arranged to be connected to the suction gas communicating pipe through the second header, and the second refrigerant pipes are configured and arranged to be connected approximately perpendicularly to the third header, and the second refrigerant pipes are configured and arranged to be connected to the liquid communicating pipe through the third header.

* * * * *